US008584768B2

(12) United States Patent
Trapp et al.

(10) Patent No.: US 8,584,768 B2
(45) Date of Patent: Nov. 19, 2013

(54) NOZZLE ASSEMBLY

(75) Inventors: James M. Trapp, Galien, MI (US); Don E. Sjolin, Granger, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 367 days.

(21) Appl. No.: 12/370,372

(22) Filed: Feb. 12, 2009

(65) Prior Publication Data

US 2009/0236446 A1 Sep. 24, 2009

Related U.S. Application Data

(60) Provisional application No. 61/087,310, filed on Aug. 8, 2008, provisional application No. 61/029,066, filed on Feb. 15, 2008.

(51) Int. Cl.
*A62C 31/22* (2006.01)

(52) U.S. Cl.
USPC ..... 169/70; 239/453; 239/455; 239/456; 239/503

(58) Field of Classification Search
USPC ..... 239/453, 452, 456, 455, 451, 261, 503; 169/70
See application file for complete search history.

(56) References Cited

U.S. PATENT DOCUMENTS

| | | | | |
|---|---|---|---|---|
| 2,218,411 | A * | 10/1940 | Albach et al. | 239/441 |
| 2,307,014 | A | 1/1943 | Becker et al. | |
| 2,806,741 | A | 9/1957 | Fishelson et al. | |
| 2,936,960 | A | 5/1960 | Thompson | |
| 2,988,289 | A | 6/1961 | Thompson | |
| 3,301,492 | A | 1/1967 | Kingsley | |
| 3,684,192 | A | 8/1972 | McMillan | |
| 3,776,470 | A | 12/1973 | Tsuchiya | |
| 3,923,247 | A * | 12/1975 | White | 239/14.2 |
| RE29,717 | E * | 8/1978 | Thompson | 239/107 |
| 4,252,278 | A * | 2/1981 | McMillan | 239/583 |
| 4,653,693 | A | 3/1987 | Steingass | |
| 4,776,517 | A | 10/1988 | Heren | |
| 4,941,614 | A * | 7/1990 | Ilott | 239/294 |
| 5,261,494 | A | 11/1993 | McLoughlin et al. | |
| 5,312,048 | A | 5/1994 | Steingass et al. | |
| 5,590,719 | A | 1/1997 | McLoughlin et al. | |

(Continued)

FOREIGN PATENT DOCUMENTS

| | | |
|---|---|---|
| JP | 63176563 | 11/1988 |
| JP | 2002102378 | 4/2002 |
| JP | 2002369892 | 12/2002 |

OTHER PUBLICATIONS

PCT Search Report dated Sep. 16, 2009 for corresponding PCT Application No. PCT/US2009/033900.

(Continued)

*Primary Examiner* — Ryan Reis
(74) *Attorney, Agent, or Firm* — Faegre Baker Daniels LLP

(57) ABSTRACT

A nozzle assembly includes a nozzle body with an inlet, an outlet, and a passageway extending from the inlet to the outlet, and with the passageway having a flow area and a fixed diameter at the outlet. A lever is supported at the nozzle body, and the nozzle assembly further includes an actuator, which is supported by the nozzle body and configured for varying the cross-section of the flow area through the outlet in response to the lever being moved relative to the nozzle body.

26 Claims, 29 Drawing Sheets

(56) References Cited

U.S. PATENT DOCUMENTS

| | | | | |
|---|---|---|---|---|
| 6,007,001 | A * | 12/1999 | Hilton | 239/452 |
| 7,195,181 | B2 * | 3/2007 | Steingass et al. | 239/581.1 |
| 7,258,285 | B1 | 8/2007 | Combs et al. | |
| 2003/0127541 | A1 * | 7/2003 | Marino | 239/539 |
| 2005/0258275 | A1 | 11/2005 | Williams | |

OTHER PUBLICATIONS

Product Brochure depicting the Elk Controlling and Shut-Off Nozzle, p. 9, date unknown, Elkhart Brass Manufacturing Co.

* cited by examiner

NOZZLE ASSEMBLY

CROSS-REFERENCE TO RELATED APPLICATION

This application claims priority from U.S. provisional Pat. Application Ser. No. 61/029,066, filed Feb. 15, 2008, entitled LEVER CONTROLLED COMBINATION ADJUSTABLE SOLID STREAM NOZZLE ASSEMBLY AND HOSE SHUTOFF VALVE, and U.S. provisional Pat. Application Ser. No. 61/087,310, filed Aug. 8, 2008, entitled NOZZLE ASSEMBLY, which are incorporated by reference herein in their entireties.

TECHNICAL FIELD AND BACKGROUND OF THE INVENTION

The present invention relates to a nozzle assemblies for structural firefighting and, more particularly, to a nozzle assembly that incorporates a nozzle stem for controlling the flow of fluid though the nozzle assembly.

Many firefighters/fire departments prefer the use of solid stream nozzles for structural firefighting. The traditional solid stream nozzle provides a single fixed discharge orifice, with no acceptable provisions for the nozzle operator to vary the flow rate through the nozzle. The flow rate can only be reduced by throttling an attached shutoff valve, typically of the ball valve type. This technique results in the loss of the desirable qualities of a solid firefighting stream, namely its reach and cohesiveness. The alternative is to shut off the control valve to stop flow to the nozzle and attach a different size nozzle tip. However, this action is often undesirable or impossible to safely accomplish within the firefighting environment.

Accordingly, there is a need for a solid stream nozzle that is adjustable within the firefighting environment without the attendant loss of the stream quality associated when throttling a conventional solid stream nozzle or the loss of use of the nozzle when changing out the nozzle tip.

SUMMARY OF THE INVENTION

Accordingly, the present invention provides a solid stream nozzle assembly that is adjustable within the fire fighting environment and, further, that optionally provides multiple distinct settings, with each setting optionally providing a performance equivalent to a standard individual smooth bore nozzle size. Furthermore, the present invention includes a nozzle assembly that optionally provides a drip tight hose shutoff device and, further, which can provide the ability to attach other types of nozzles or nozzle tips to the discharge end of the nozzle assembly. In addition, the nozzle assembly may provide a single control lever that provides control over the nozzle orifice adjustment and, further, the hose shutoff function.

In one form of the invention, a solid stream nozzle assembly includes a nozzle body with an inlet, an outlet, and a passageway extending from the inlet to the outlet, with the passageway having a flow area and a fixed diameter at the outlet. A lever is supported at the nozzle body, and the nozzle assembly further includes an actuator. The actuator is supported by the nozzle body and configured for varying the cross-section of the flow area through the outlet in response to the lever being moved relative to the nozzle body.

In one aspect, the actuator includes a movable body in the passageway, with the movable body being supported for linear movement in the passageway and being responsive to movement of the lever.

Further, the movable body may include a sealing surface for sealing the outlet when the movable body is moved to a closed position in response to the lever being moved to a position for shutting off flow through the nozzle assembly.

In a further aspect, the movable body has a generally bicone-shaped body.

In yet another aspect, the solid stream nozzle assembly further includes a stream shaper, which is coupled to the movable body and moves with the movable body when the movable body is moved in the passageway in response to movement of the lever. Optionally, the stream shaper supports the movable body in the passageway.

In a further aspect, the stream shaper includes an outer cylindrical wall, an inner cylindrical wall, and a plurality of webs extending between the outer cylindrical wall and the inner cylindrical wall to define a plurality of passageways.

In another aspect, the lever includes a plurality of predefined positions which cause the actuator to adjust the flow area of the nozzle assembly outlet to corresponding outlet flow areas of a plurality of conventional fixed orifice nozzles.

In yet another aspect, the actuator comprises a movable sleeve, which is movably mounted in the passageway and which is coupled to the movable body and the stream shaper. In addition, the movable sleeve is coupled, either indirectly or directly, to the lever such that movement of the lever imparts movement to the sleeve, which in turn imparts movement to the movable body and stream shaper. For example, the sleeve may be coupled to the lever by one or more pins. In a further aspect, the sleeve includes an engagement structure which is engaged by the pin or pins, which may be directly coupled to the lever or may be formed as part of the lever. Alternately, the pin or pins may be provided on the sleeve, and the lever is provided with the engagement structure.

In another form of the invention, a solid stream nozzle assembly includes a nozzle body with an inlet, an outlet, and a passageway extending from the inlet to the outlet, and with the passageway having a fixed diameter at the outlet. A movable body is supported in the passageway for linear movement in the passageway wherein the movable body reduces the flow area through the outlet when moved toward the outlet and increases the flow area when moved away from the outlet. The movable body includes a sealing surface for sealing the outlet when the movable body is moved to a closed position for shutting off flow through the nozzle assembly. The nozzle assembly further includes an actuator, which is supported by the nozzle body and configured for moving the movable body in the passageway.

In one aspect, the nozzle assembly further includes a lever supported at the nozzle body, with the actuator moving the movable body in response to movement of the lever.

In a further aspect, the lever may include a plurality of predefined positions corresponding to predefined positions of the movable body. For example, the predefined positions may correspond to outlet flow areas of a plurality of conventional fixed orifice nozzles.

In another aspect, the nozzle assembly further includes a stream shaper, which is coupled to the movable body and moves with the movable body when the movable body is moved in the passageway in response to the actuator. For example, the stream shaper may support the movable body in the passageway.

In yet another aspect, the nozzle body includes a central nozzle body, an outlet adapter mounted to the central nozzle body, and an inlet adapter mounted to the central nozzle body. For example, the inlet adapter may comprise an inlet adapter assembly with an adapter base mounted to the central nozzle body and a swivel inlet rotatably mounted in the adapter base.

According to yet another aspect, the outlet adapter includes a connection, such as a threaded connection for mounting an accessory to the nozzle body.

In another form of the invention, a solid stream nozzle assembly includes a nozzle body with an inlet, an outlet, and a passageway extending from the inlet to the outlet, with the passageway having a flow area and a fixed diameter at the outlet. A stem is supported in the passageway and configured with a varying cross-section so that when the stem is moved longitudinally in the passageway the cross-section of the flow area through the passageway may be varied. The stem is supported for linear movement in the passageway and further such that its distal end is free to move laterally within the passageway so that the water flow through the passageway centers the distal end of the stem in the passageway.

In one aspect, the nozzle assembly further includes a lever, with the stem being responsive to movement of the lever. Further, the stem may include a sealing surface for sealing the outlet when the stem is moved to a closed position in response to the lever being moved to a position for shutting off flow through the nozzle assembly.

According to yet another aspect, the stem comprises an elongate body with the distal end formed at one end of the elongate body and a proximal end formed at the opposed end. The proximal end is supported by swivel connection in the passageway wherein the distal end may swivel or pivot with respect to the proximal end and move laterally in the passageway, which allows the fluid flowing in the passageway to center the stem in the passageway.

In yet another aspect, the solid stream nozzle assembly further includes a stream shaper, which is coupled to the stem and moves with the stem when the stem is moved in the passageway in response to movement of the lever. In a further aspect, the proximal end of the stem is pivotally mounted to the stream shaper wherein the distal end of the stem may swivel or pivot laterally with respect the stream shaper.

In another form of the invention, a solid stream nozzle assembly includes a nozzle body with an inlet, an outlet, and a passageway extending from the inlet to the outlet, and with the passageway having a fixed diameter at the outlet. A stem with an elongated body is supported in the passageway for linear movement in the passageway wherein when moved along the passageway reduces the flow area through the outlet when the distal end of the elongate body is moved in a direction toward the outlet and increases the flow area when the distal end is moved away from the outlet. Further, the elongated body is supported in the passageway such that the distal end is free to pivot about the proximal end of the elongated body to allow the fluid flowing in the passageway to center the stem in the passageway.

In any of the inventions, the lever may comprise a handle, such as an inverted U-shaped handle.

According to yet another invention, a method of centering a component in a flow passageway of a fire fighting device includes providing a support in the center of the flow passageway and mounting the component to the support in the flow passageway using a swivel connection such that the flow of fluid through the flow passageway and around the component will center the component in the passageway.

Accordingly, the present invention provides a solid stream nozzle assembly that is adjustable within the fire fighting environment and, further, that optionally provides multiple distinct settings, with each setting providing a performance equivalent to a standard individual smooth bore nozzle size. Furthermore, the present invention includes a nozzle assembly that optionally provides a drip tight hose shutoff device and, further, which can provide the ability to attach other types of nozzles or nozzle tips to the discharge end of the nozzle assembly. Furthermore, the nozzle assembly may provide control over the nozzle orifice adjustment and, further, a hose shutoff function using the same control lever.

These and other objects, advantages, purposes, and features of the invention will become more apparent from the study of the following description taken in conjunction with the drawings.

DETAILED DESCRIPTION OF THE PREFERRED EMBODIMENT

Figure 1:
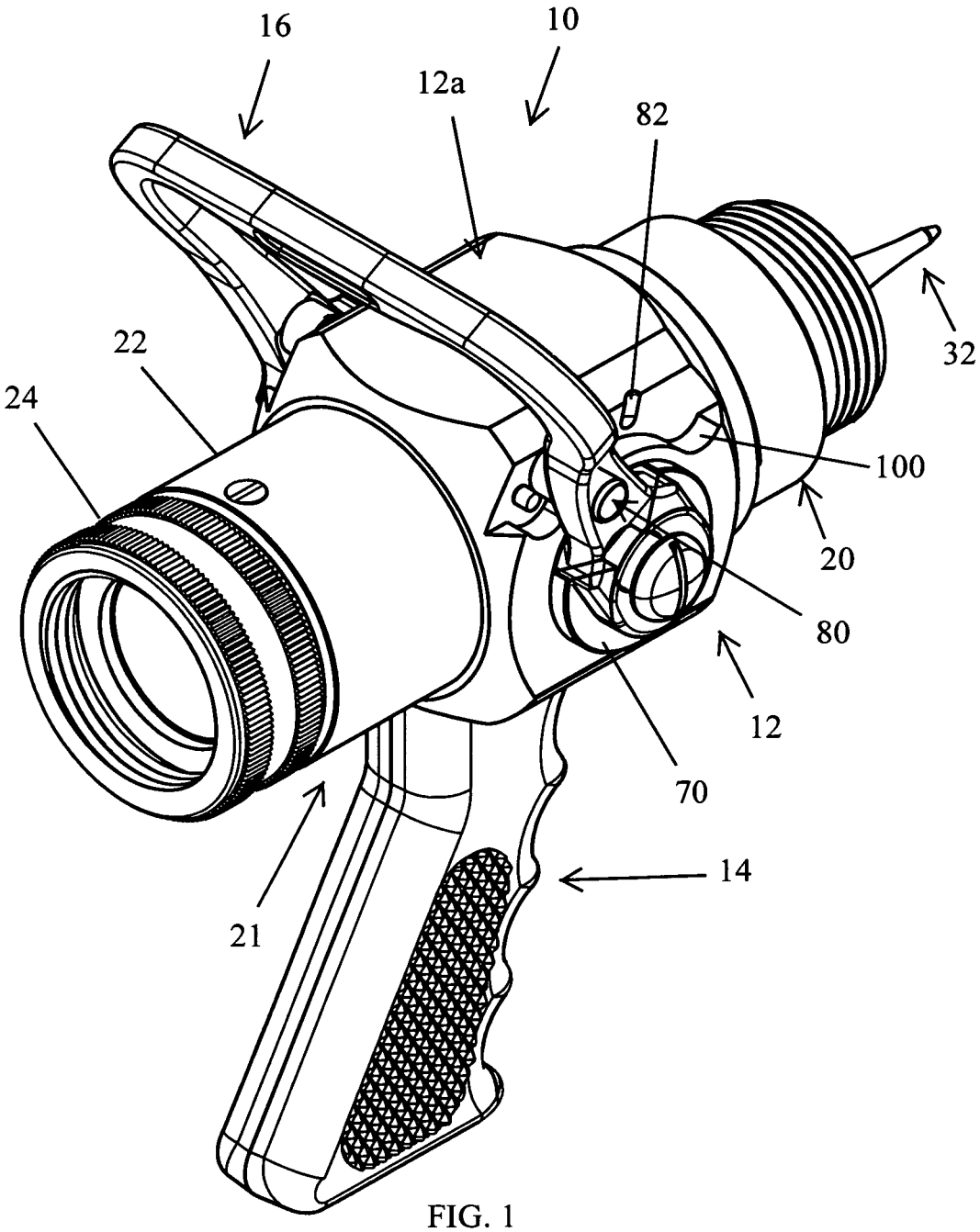
FIG. 1 is a perspective view of a solid stream nozzle of the present invention.
Figure 2:
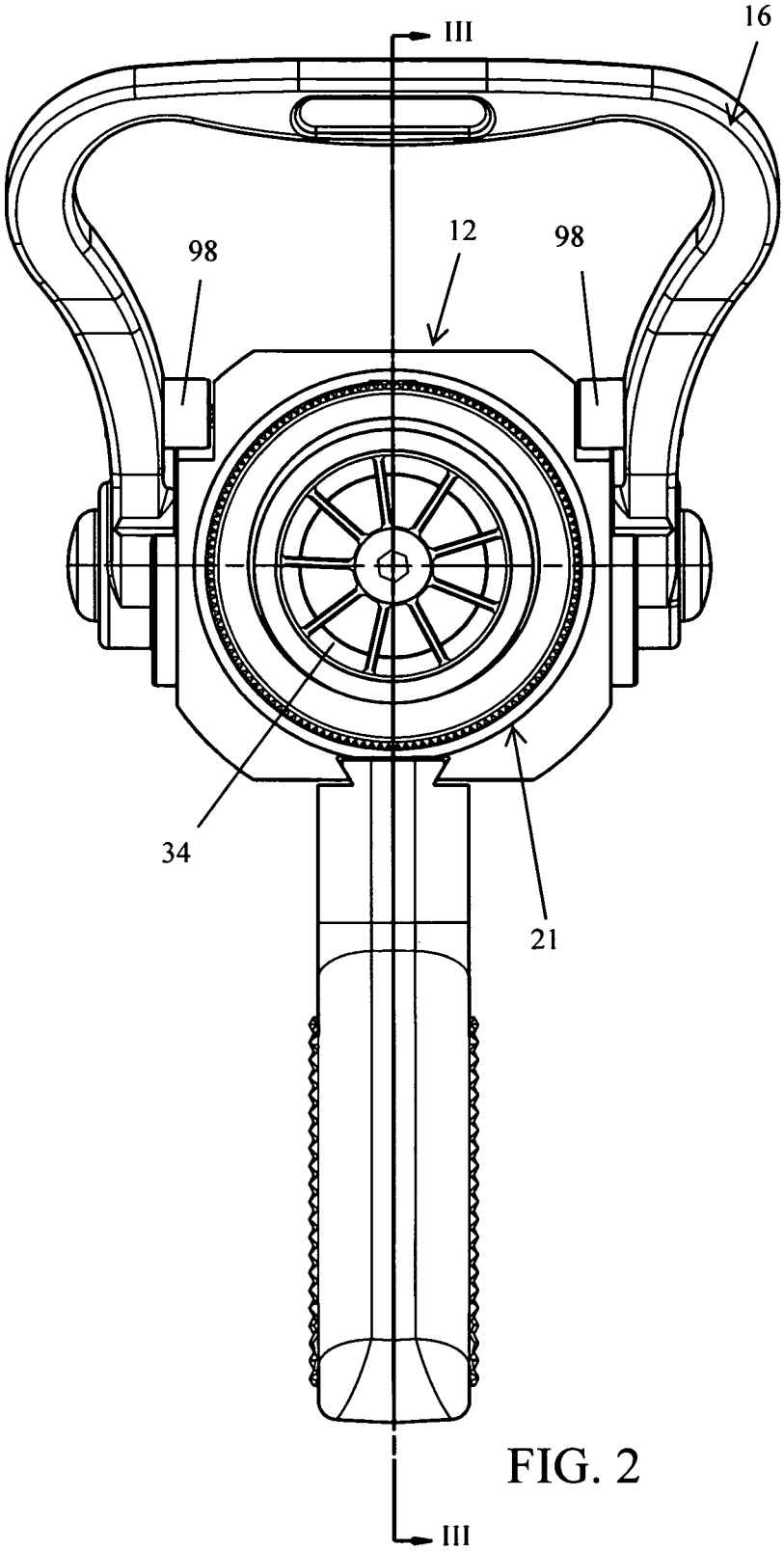
FIG. 2 is an inlet elevation view of the nozzle assembly of FIG. 1.

Referring to FIG. 1, the numeral 10 generally designates a solid stream nozzle assembly of the present invention. As will be more fully described below, solid stream nozzle assembly 10 provides a mechanism that provides adjustment to the nozzle outlet or orifice and, further, which optionally provides a shutoff function. Furthermore, the adjustment mechanism may be configured to provide shutoff capability such that a single handle may be used for nozzle orifice adjustment as well as for shutting off the flow of fluid through the nozzle assembly.

In the illustrated embodiment, nozzle 10 includes a nozzle body 12 with a pistol grip handle 14 mounted to the nozzle body to provide a handheld solid stream nozzle. However, it should be appreciated that handle 14 is optional. Mounted about body 12 is a second handle 16, which is coupled to an adjustment mechanism 18 (FIG. 3), which is located in nozzle body 12 to adjust the cross-section of the flow area of the nozzle orifice in response to the movement of handle 16.

Figure 3:
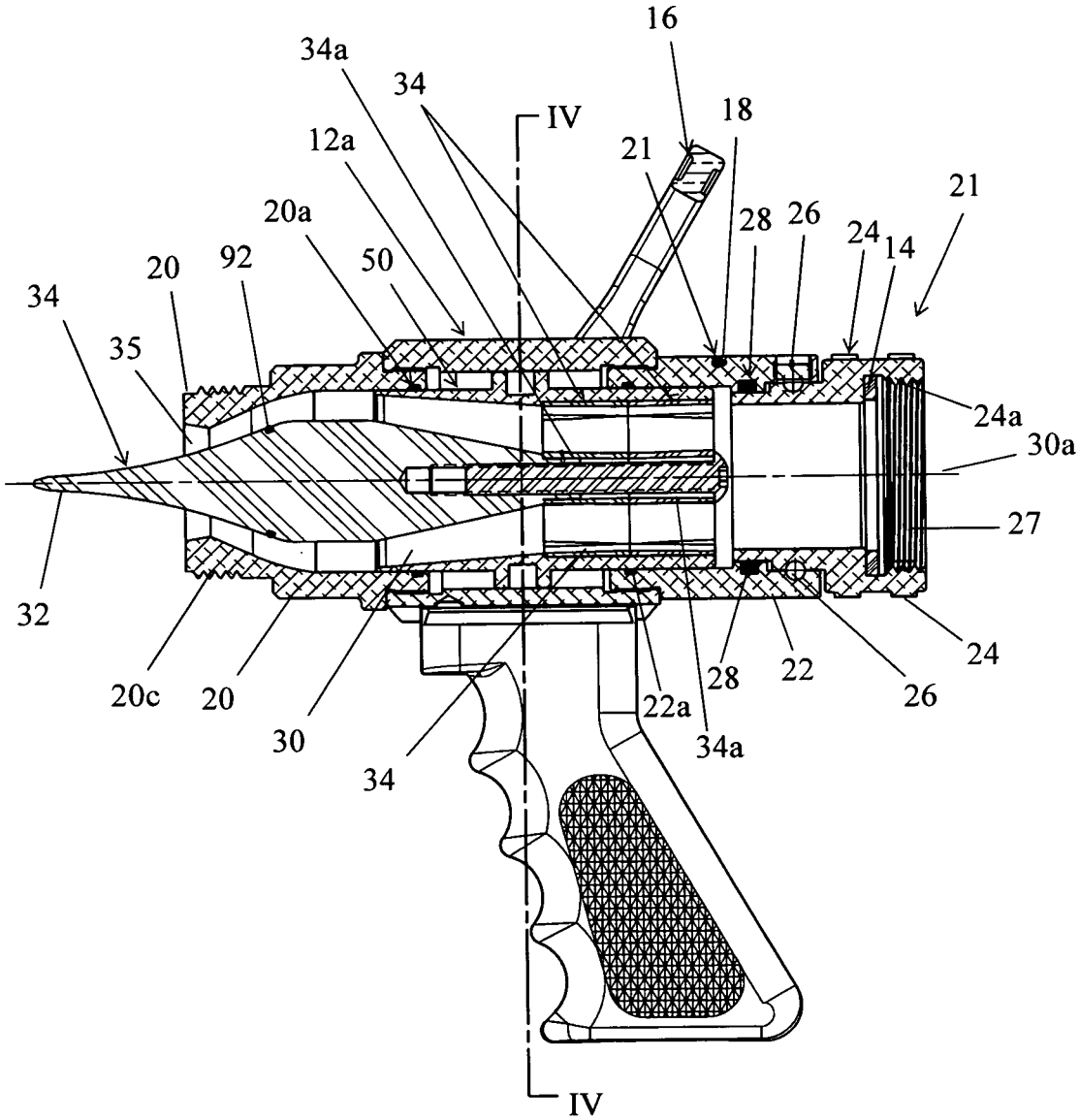
FIG. 3 is a cross-section view taken along line III-III of FIG. 2.
Figure 4:
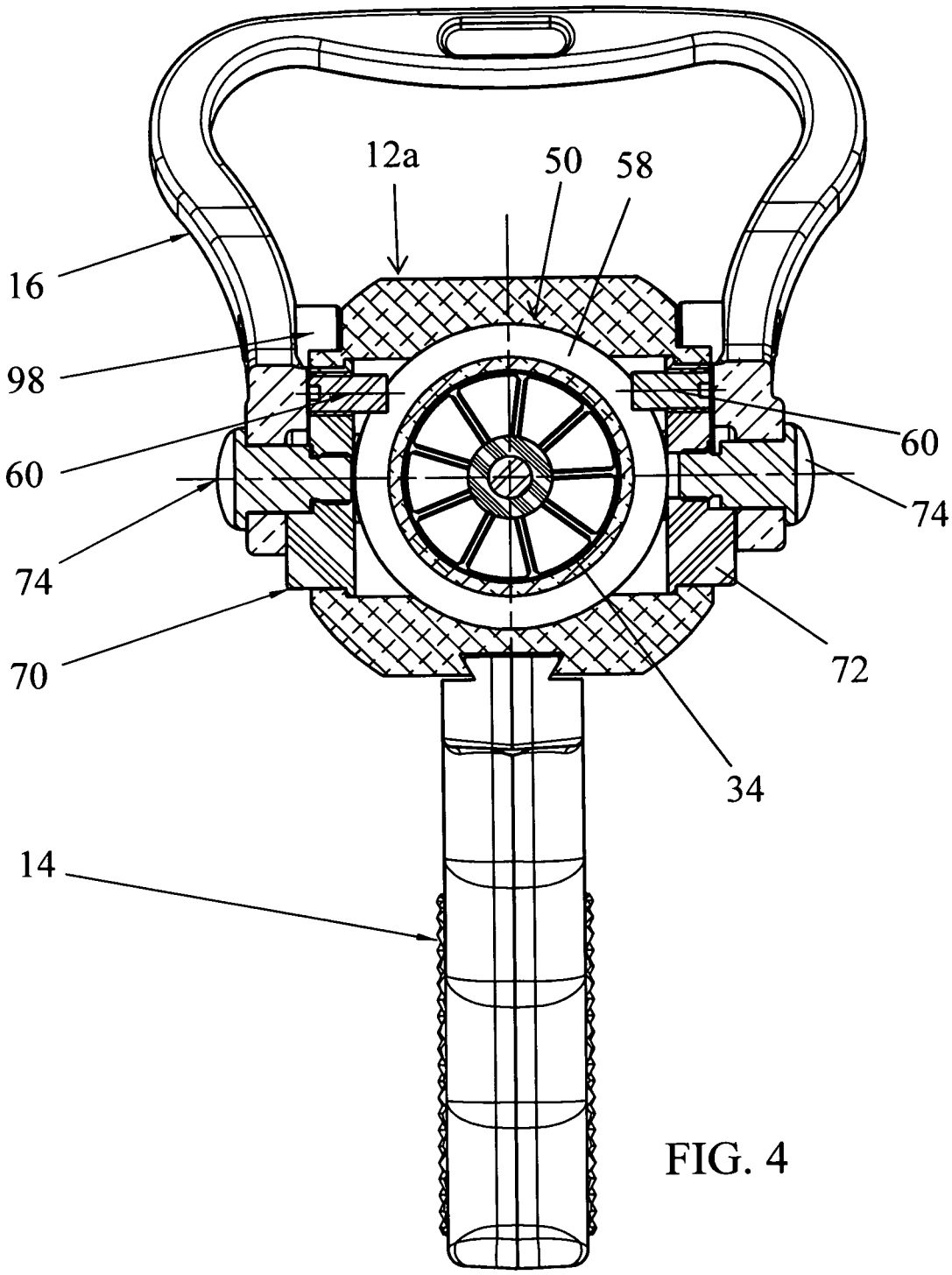
FIG. 4 is a cross-section view taken along line IV-IV of FIG. 3.
Figure 15:
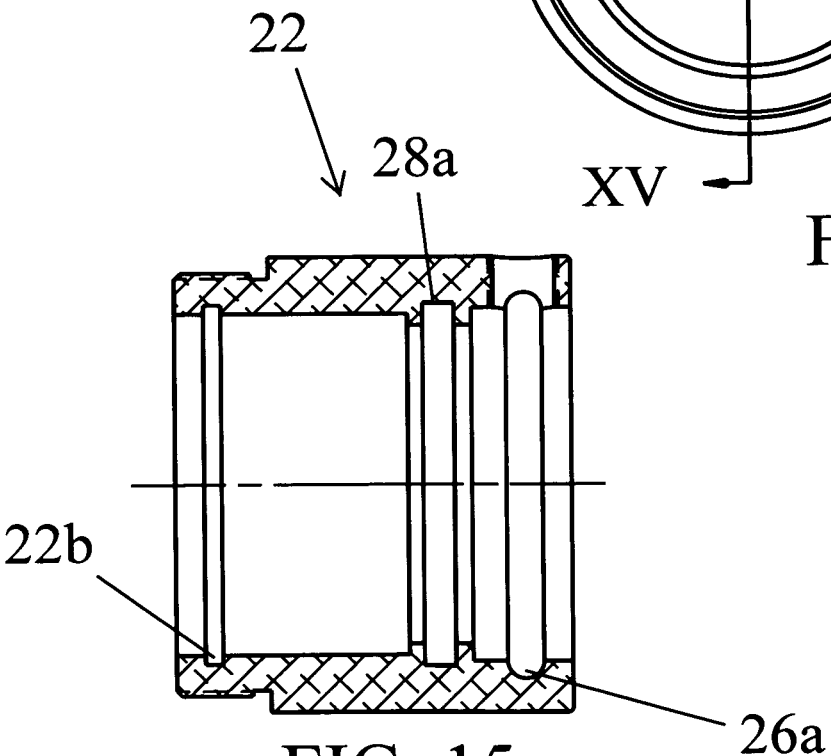
FIG. 15 is a cross-section view taken along line XV-XV of FIG. 14.
Figure 16:
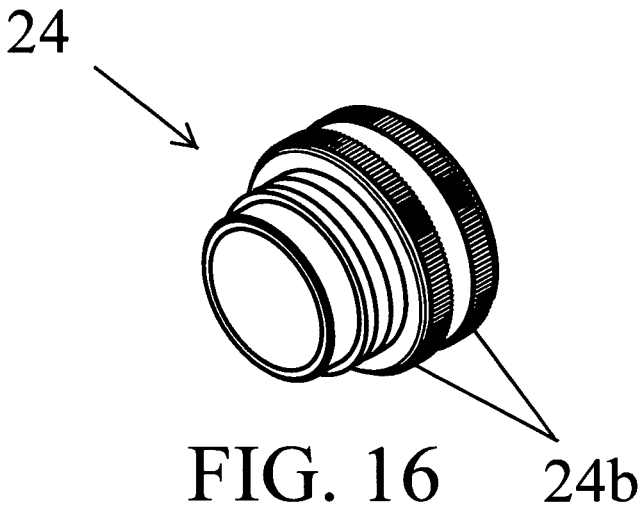
FIG. 16 is a perspective view of the movable inlet body.
Figure 17:
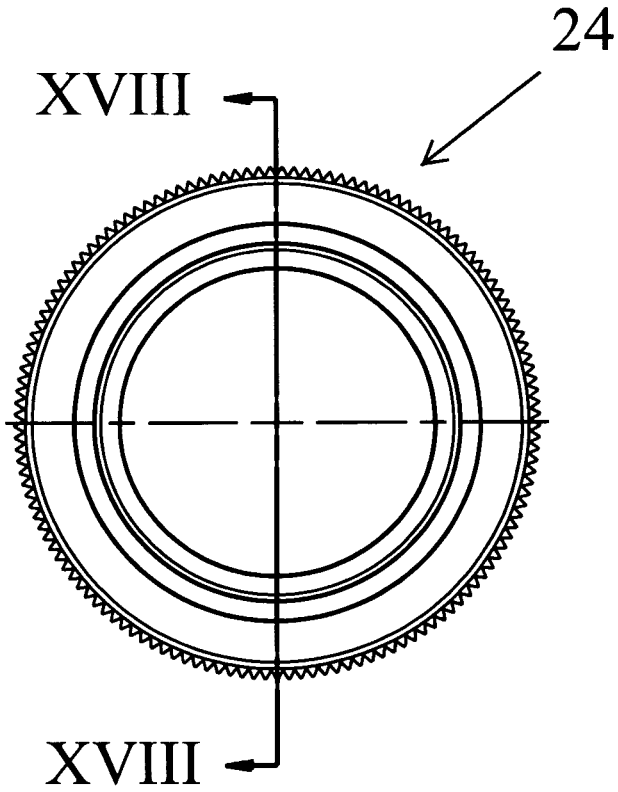
FIG. 17 is an end elevation view of the movable inlet body of FIG. 16.
Figure 18:
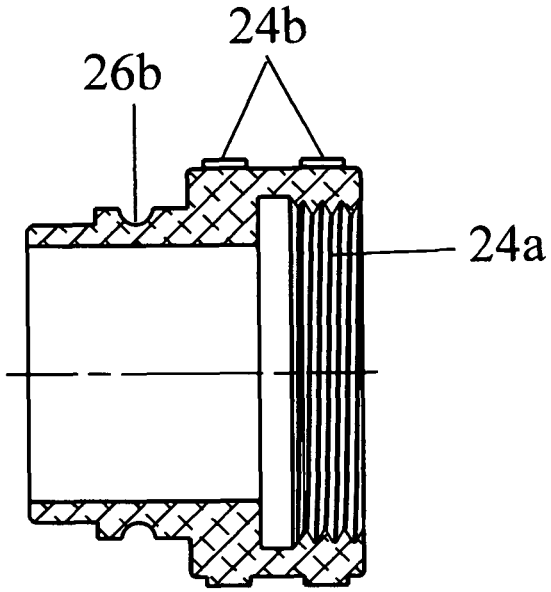
FIG. 18 is a cross-section view taken along line XVIII-XVIII of FIG. 17.
Figure 19:
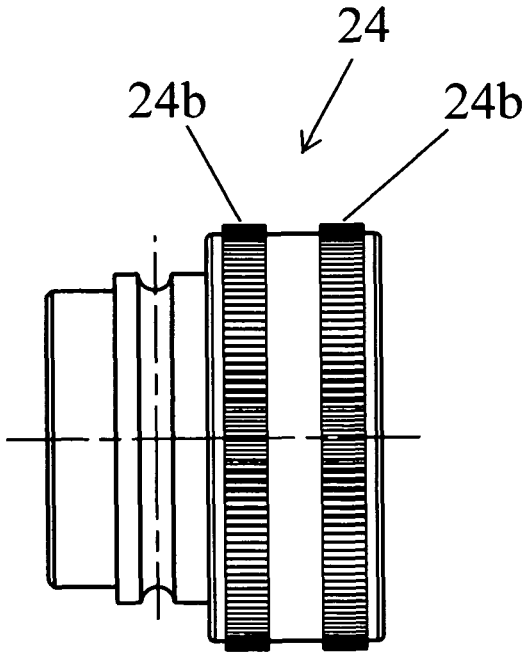
FIG. 19 is a side elevation view of the movable inlet body of FIG. 16.
Figure 20:
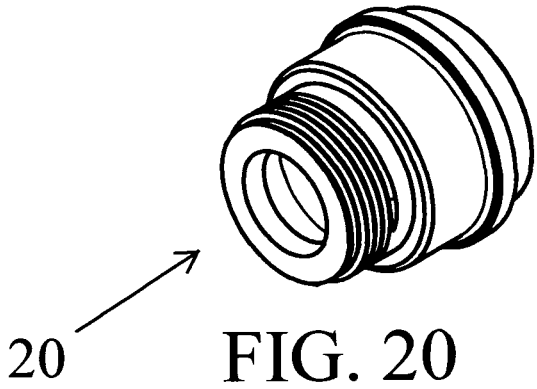
FIG. 20 is a perspective view of the nozzle discharge adapter body.
Figure 21:
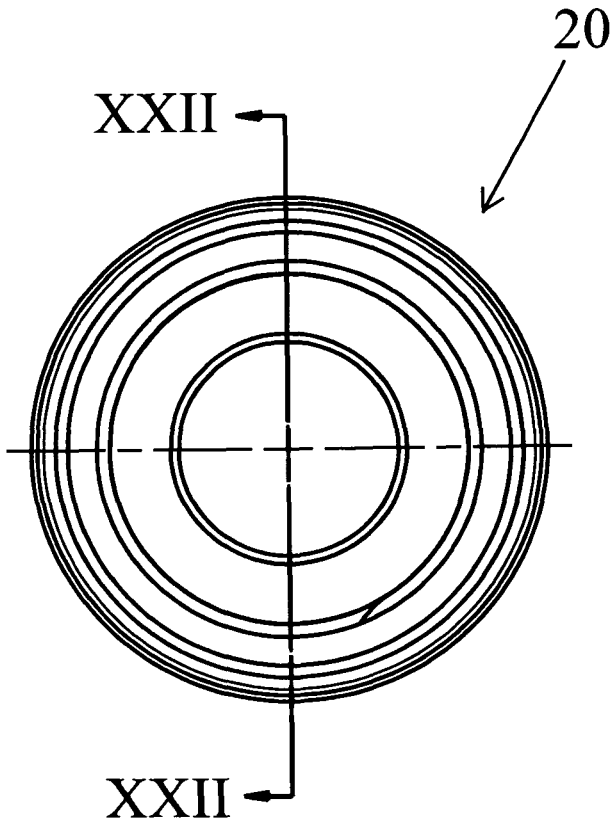
FIG. 21 is an end elevation view of the nozzle discharge adapter body of FIG. 20.
Figure 22:
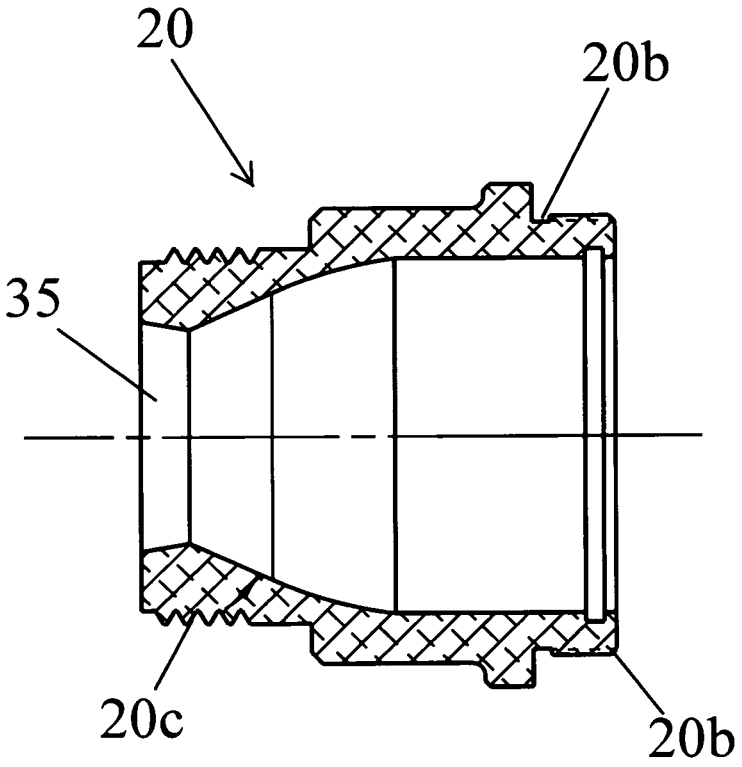
FIG. 22 is a cross-sectional view taken along XXII-XXII of FIG. 21.
Figure 23:
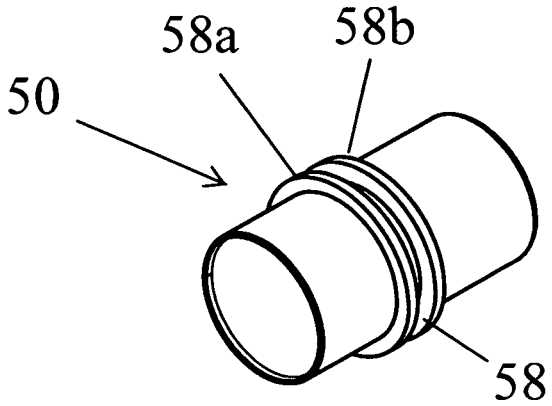
FIG. 23 is a perspective view of the nozzle actuator sleeve.
Figure 24:
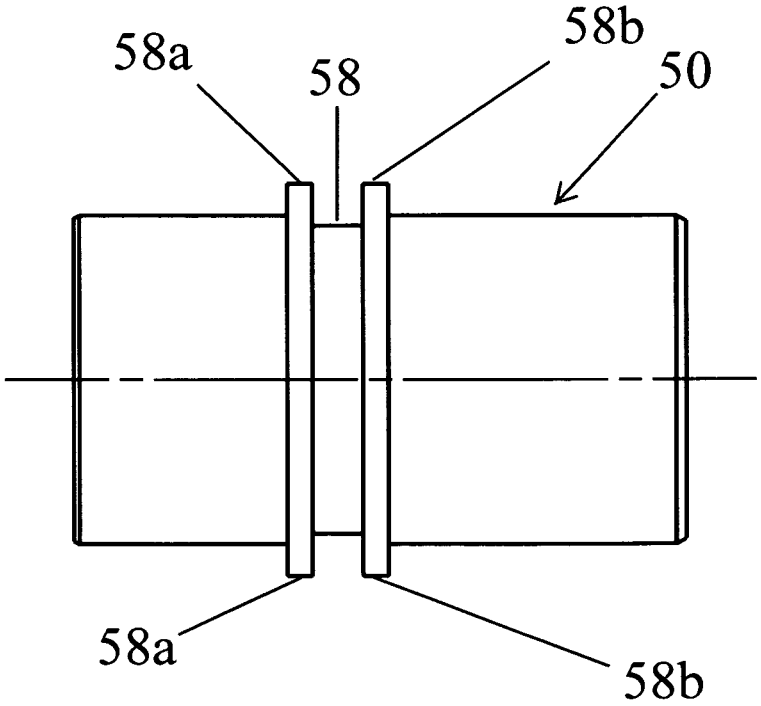
FIG. 24 is a side elevation view of the nozzle actuator sleeve of FIG. 23.
Figure 25:
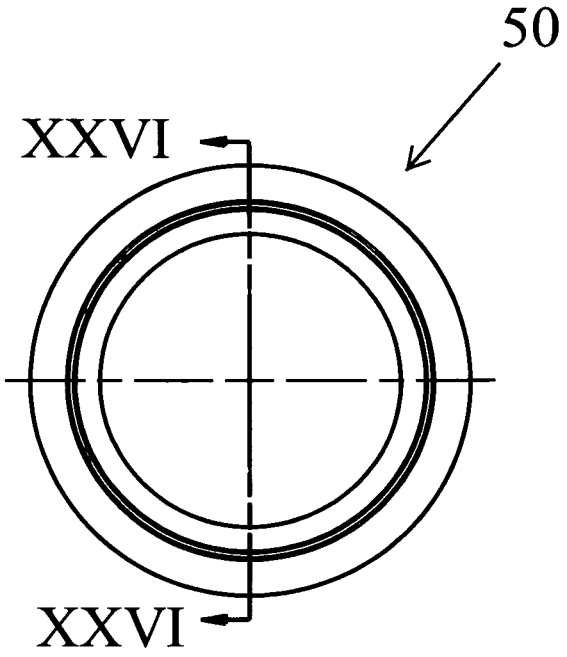
FIG. 25 is an end elevation view of the actuator sleeve of FIG. 23.
Figure 26:
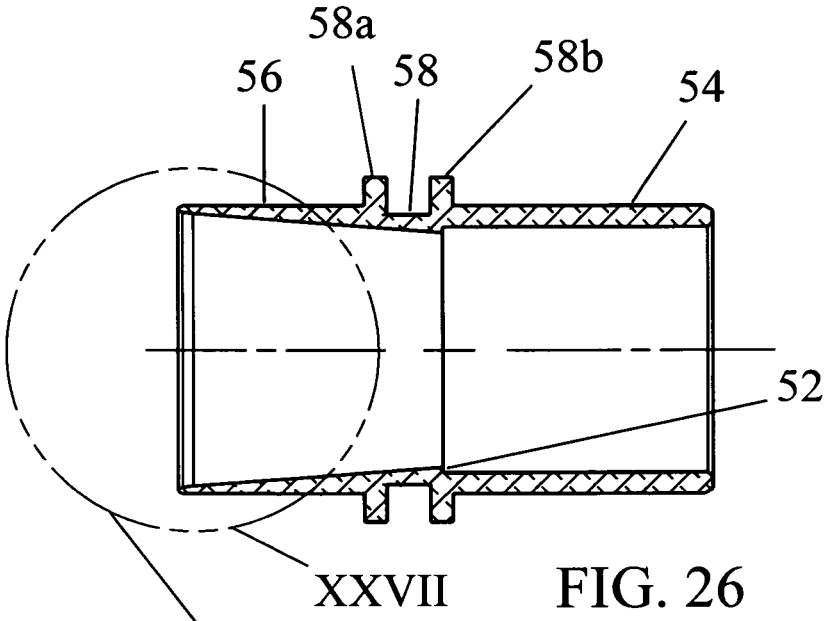
FIG. 26 is a cross-section view taken along line XXVI-XXVI of FIG. 25.
Figure 27:
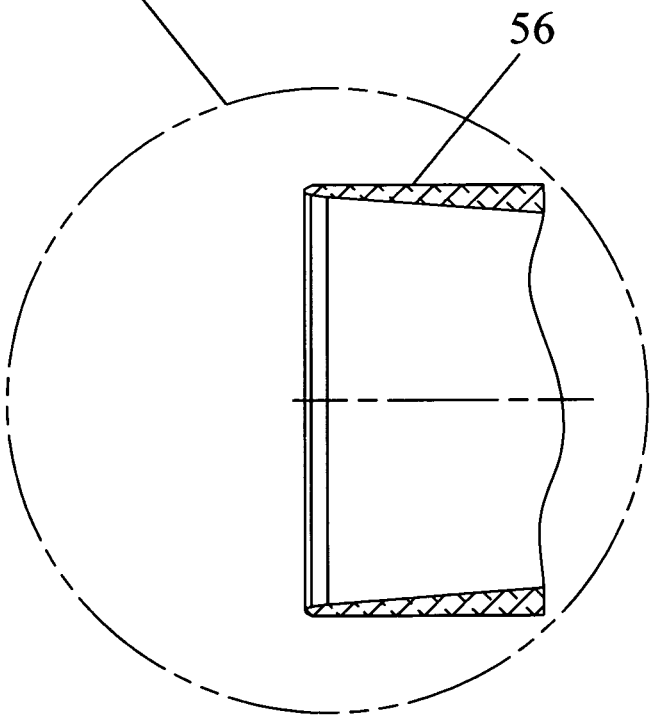
FIG. 27 is an enlarged detailed view of the section labeled XXVII of FIG. 26.

As best seen in FIG. 3, nozzle body 12 includes a central nozzle body 12*a* and an outlet adapter 20, which is threaded into central nozzle body 12*a* and includes a threaded end 20*c* to allow another attachment, for example another nozzle or nozzle tip, to be added to nozzle assembly 10. Further, mounted at the opposed end of central nozzle body 12*a*, also by a threaded connection, is an inlet adapter assembly 21. Inlet adapter assembly 21 includes a fixed inlet adapter base 22, which is threaded into central nozzle body 12, and a swivel inlet adapter body 24. Adapter body 24 is rotatably mounted in fixed base 22 by a plurality of bearings 26 and, further, sealed therein by a seal 28, such as an o-ring seal, which is located in groove 28*a*. Bearings 26 ride on bearing races 26*a* (FIG. 15) and 26*b* (FIG. 18) provided on base 26 and inlet body 24. Adapter body 24 includes a connection, such as a female hose thread 24*a*, to allow a hose to be coupled to the adapter body 24 and, hence, to nozzle assembly 10. To facilitate the coupling of adapter body 24 to a hose, adapter body 24 may include one or more knurled surfaces 24*b*. Central nozzle body 12*a* and the adapters are typically formed from a metal, such as aluminum or brass.

Referring again to FIG. 3, nozzle body 12 defines a transverse flow passageway 30 with a central longitudinal axis 30*a*. Located in passageway 30 are a nozzle stem 32 and, further, a stream shaper 34, which are both mounted for linear movement along axis 30*a*. Stream shaper 34 optionally supports nozzle stem 32 in passage and is mounted to the end of the nozzle stem body 32 by a fastener 34*a*. Stream shaper 34, which is located between nozzle stem 32 and the inlet of nozzle assembly, reduces the scale of turbulence in the incoming water flow, which improves the quality of discharge from the fire stream. Adjustment mechanism 18 is coupled to stream shaper 34, which as noted is mounted for linear movement along axis 30*a* along with nozzle stem 32, which moves towards or away from nozzle outlet 35 in response to adjustment mechanism 18 to vary the cross-section of the flow area at and just upstream from outlet 35 and thereby adjust flow rate through the nozzle assembly. Further, when fully extended in passageway 30, nozzle stem 32 is configured to close outlet 35 and block the flow of fluid through the nozzle assembly to thereby provide a shutoff function.

Figure 32:
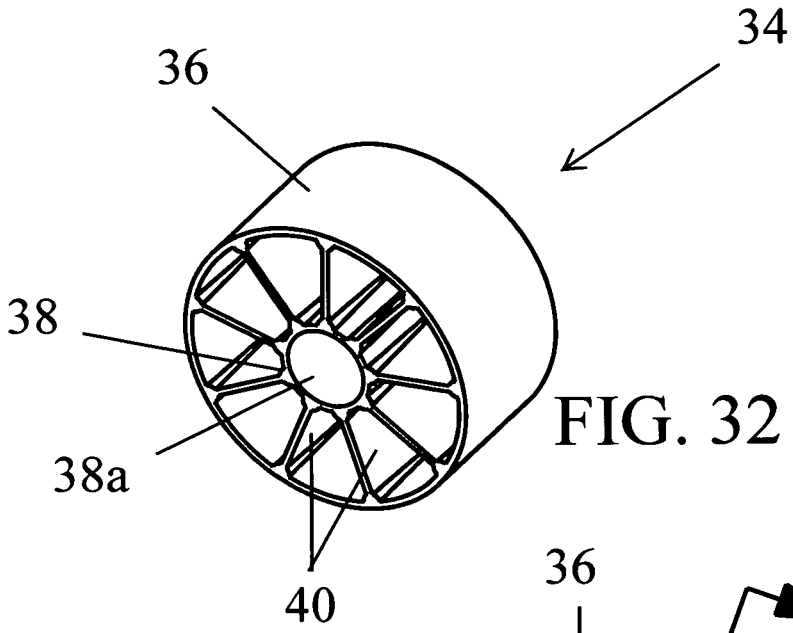
FIG. 32 is a perspective view of the stream shaper.
Figure 33:
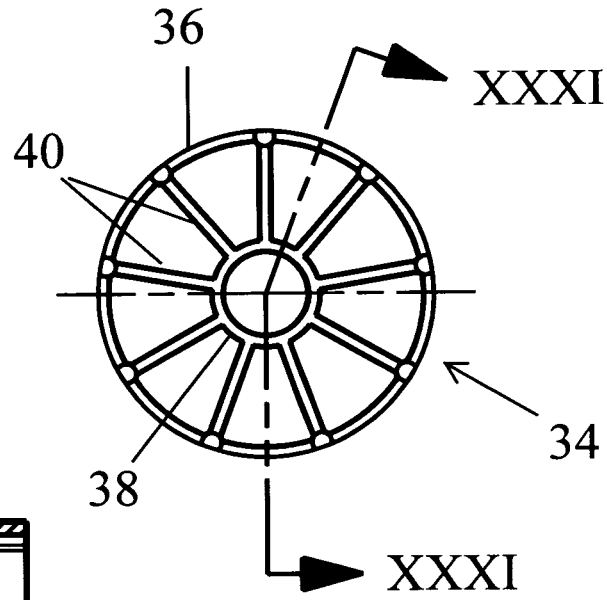
FIG. 33 is an end elevation view of the stream shaper of FIG. 32.
Figure 34:
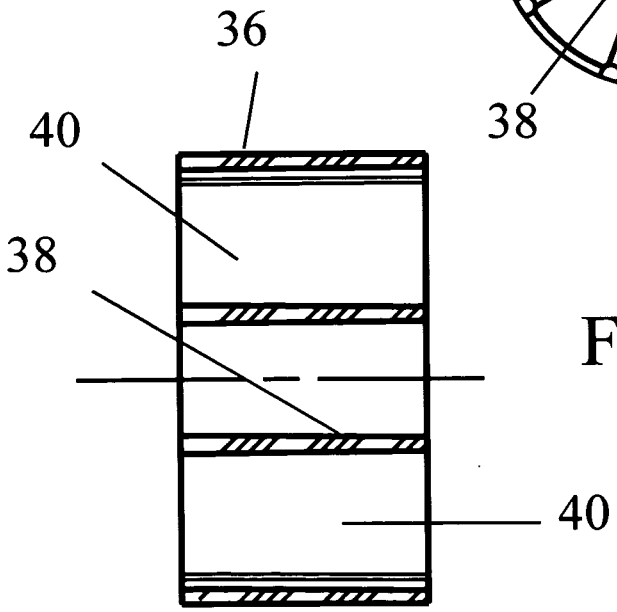
FIG. 34 is a cross-section view taken along line XXXIV-XXXIV of FIG. 33.
Figure 35:
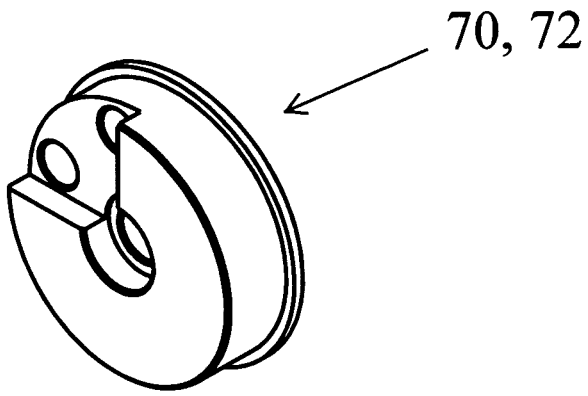
FIG. 35 is a perspective view of the actuator disk.
Figure 36:
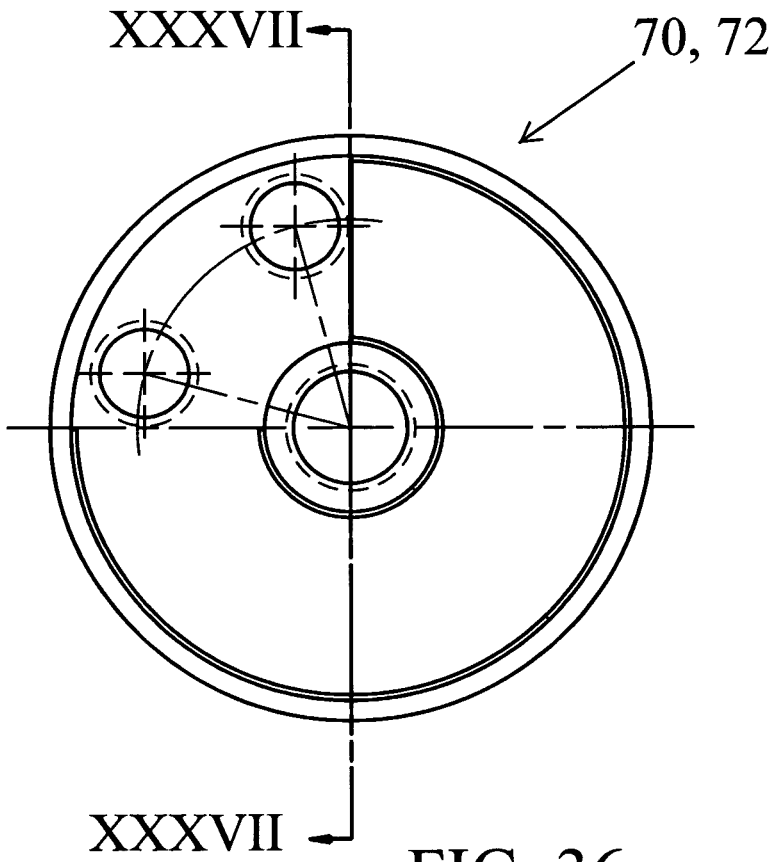
FIG. 36 is an elevation view of the actuator disk of FIG. 35.
Figure 37:
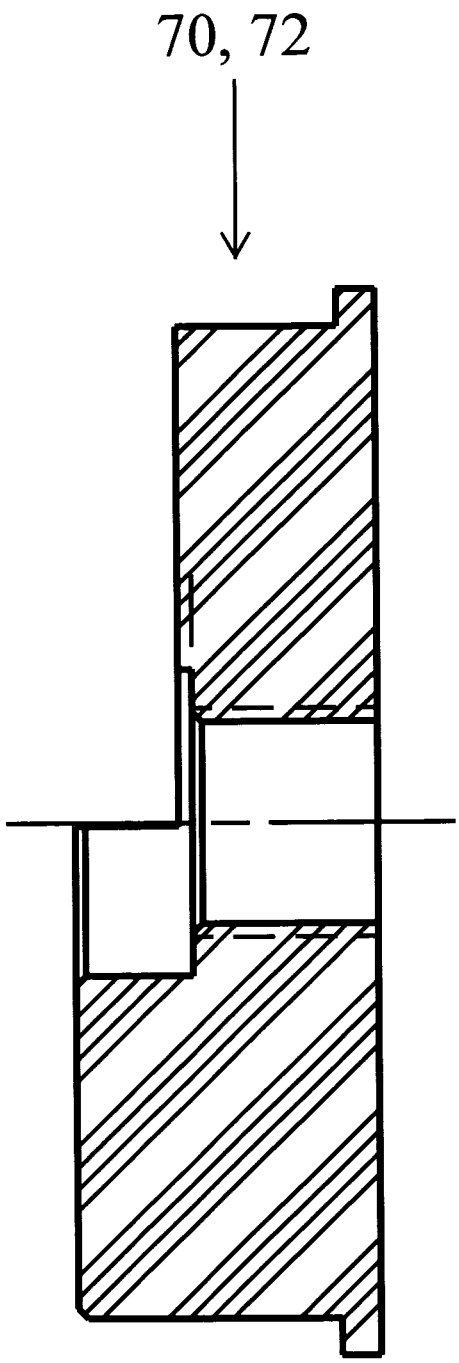
FIG. 37 is a cross-section view taken along line XXXVII-XXXVII of FIG. 36.
Figure 38:
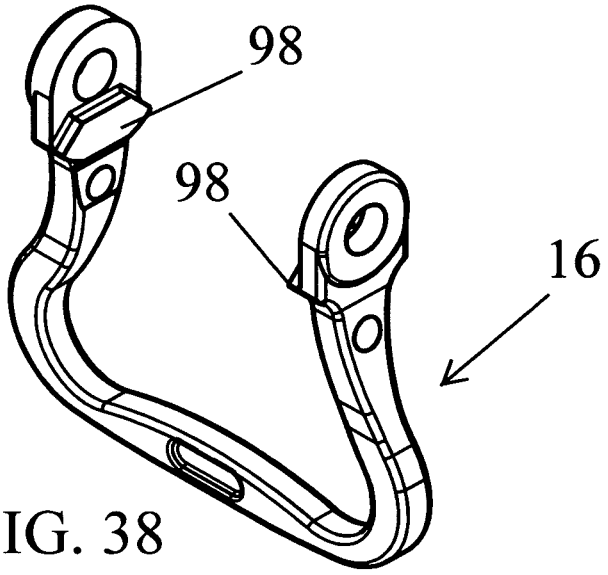
FIG. 38 is a perspective view of the nozzle assembly handle.
Figure 39:
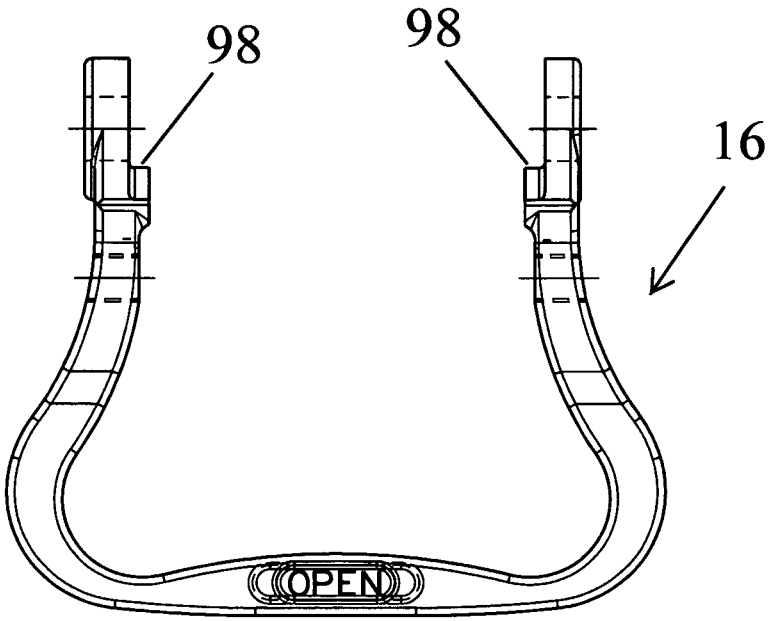
FIG. 39 is a plan view of the nozzle assembly handle.
Figure 40:
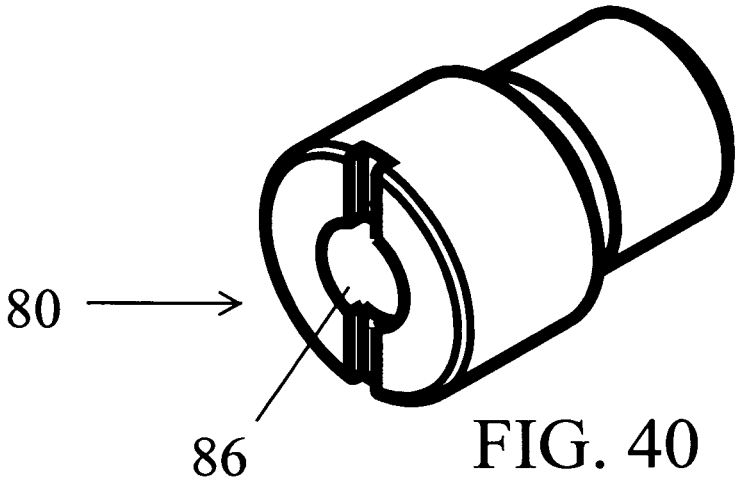
FIG. 40 is an enlarged perspective view of a detent mechanism.
Figure 41:
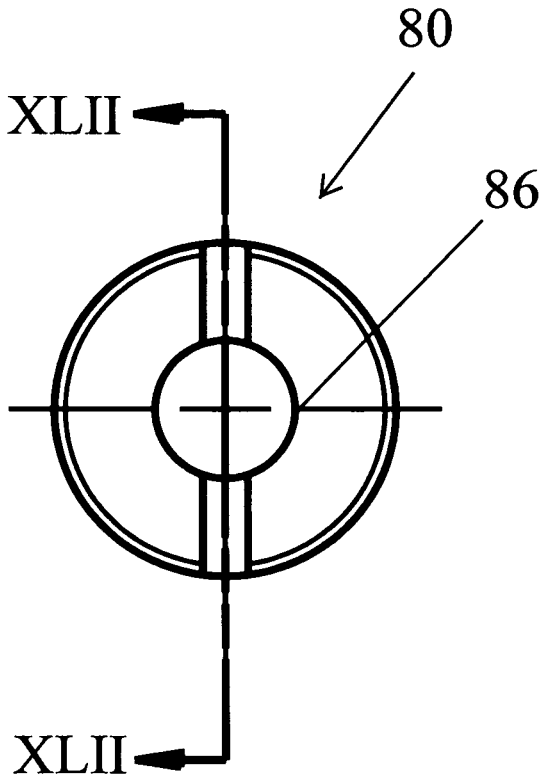
FIG. 41 is an end elevation view of the detent mechanism of FIG. 40.
Figure 42:
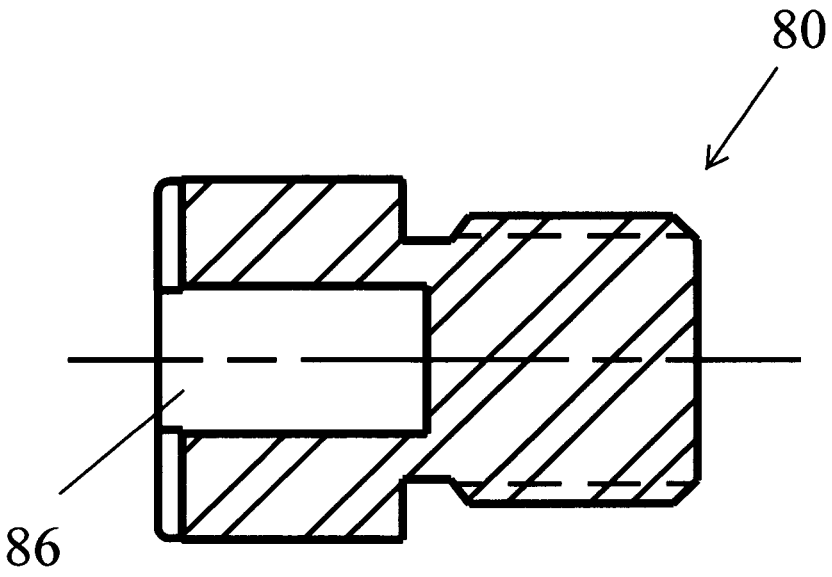
FIG. 42 is a cross-section view taken along line XLII-XLII of FIG. 41.
Figure 42A:
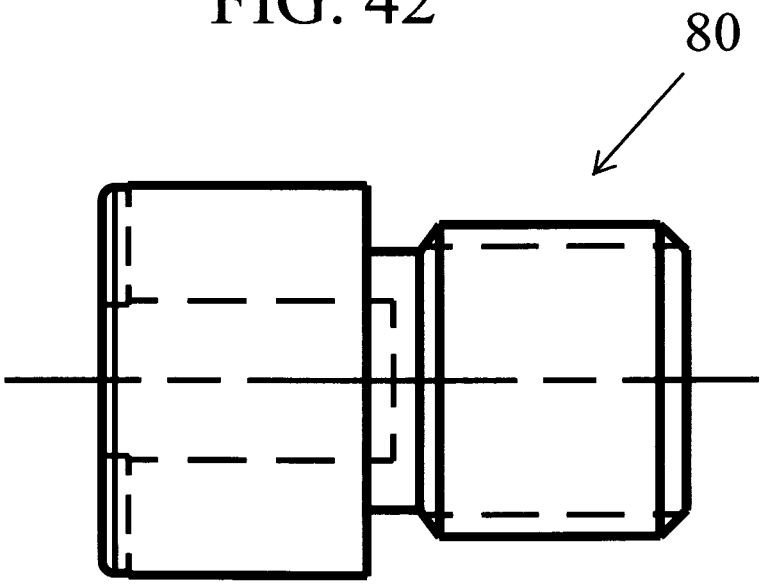
FIG. 42*a* is a side view of the detent mechanism of FIG. 40.

Referring to FIGS. 32-34, stream shaper 34 comprises an outer cylindrical wall 36 and an inner cylindrical wall 38 spaced inwardly from the outer cylindrical wall 36. Inner cylindrical wall 38 is supported inwardly of outer cylindrical wall 36 by a plurality of webs 40, which extend from inner cylindrical wall 38 to outer cylindrical wall 36. In the illustrated embodiment, webs 40 are uniformly spaced about inner cylindrical wall 38. Further, in the illustrated embodiment, nine webs 40 are provided; however it should be understood that the number of webs and the spacing between the respective webs may be varied depending on the size of the nozzle assembly and the desired reduction in turbulence of the water flowing through the nozzle assembly. The flow shaper may be formed from a plastic material, such as acetyl, or a metal material, such as brass.

Figure 28:
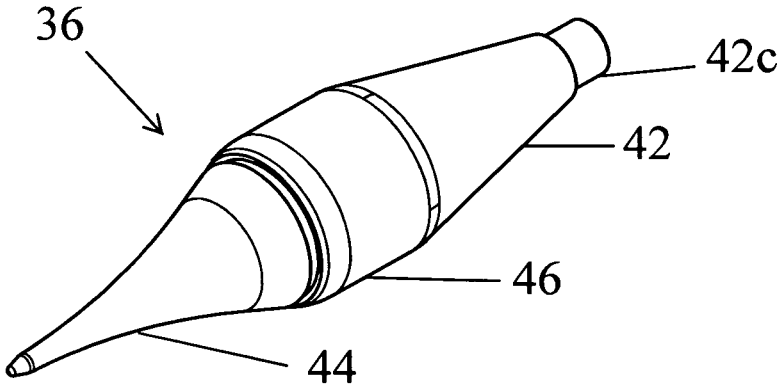
FIG. 28 is a perspective view of the nozzle stem body.
Figure 29:
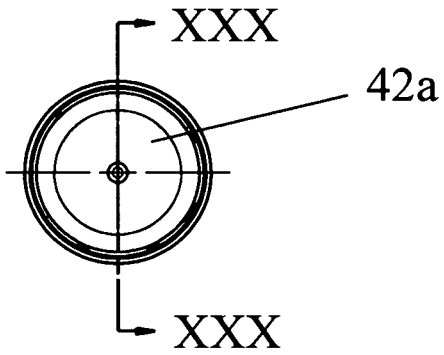
FIG. 29 is an end elevation view of the nozzle stem body of FIG. 28.
Figure 30:
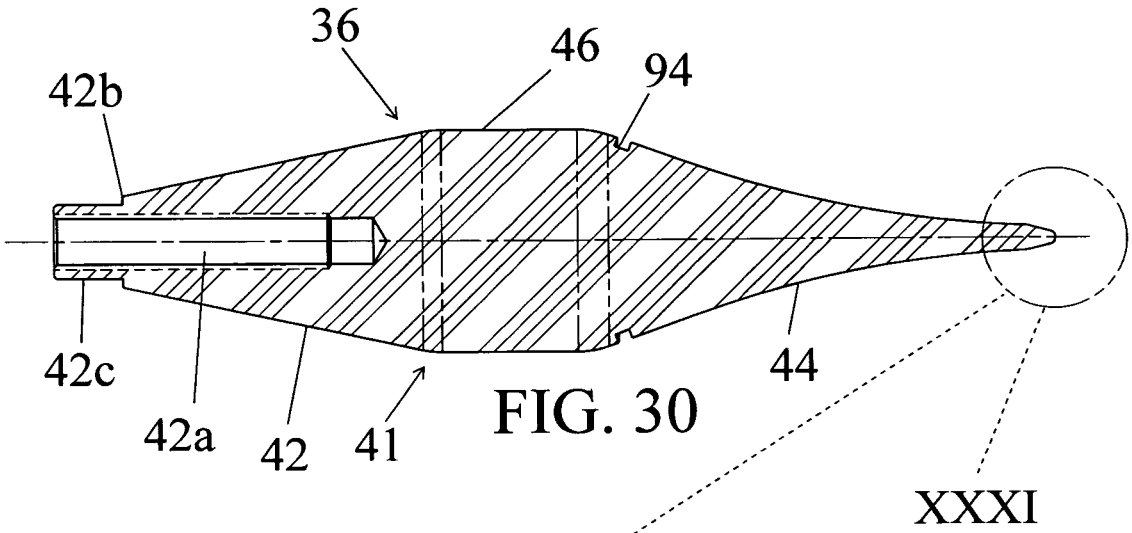
FIG. 30 is a cross-section view taken through line XXX on FIG. 29.
Figure 31:
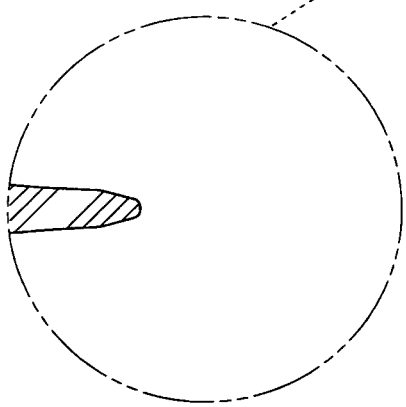
FIG. 31 is an enlarged detailed view of detail XXXI on FIG. 30.

Referring to FIGS. 28-30, nozzle stem 32 comprises a generally bicone-shaped body 41 with one end 42 of body 41 comprising a linear cone-shaped portion and an opposed end 44 of body 41 comprising a curvilinear cone-shaped portion. The respective cone-shaped portions are joined by a cylindrical-shaped portion 46. Body 41 is formed from a fairly rigid but light weight material, such as a polymer, for example DELRIN. As best understood from FIG. 3, stream shaper 34 is mounted to the linear cone-shaped end 42 of nozzle stem 36 by fastener 34*a*, which extends into a threaded opening 42*a* formed in end 42 of bi-cone-shaped body 41. Further, inner cylindrical wall 38 rests on a shoulder 42*b* provided on end 42 of bicone-shaped body 41.

Thus, when nozzle stem 32 is located in passageway 30, which has a varying cross-section through outlet adapter 20, an annular flow path is defined between the nozzle stem 32 and nozzle body 12, with the inner limits of the flow path being defined by the end of the conical end section member (42) and the outer limits by a combination of parts. The cross-sectional area of the flow path is designed to gradually and uniformly decrease to thus mimic the flow path of a conventional solid stream nozzle, resulting in a gradual and uniform increase in flow velocity. As the flow approaches the exit orifice or outlet, the internal limits and external limits of the flow path are formed with axially converging angles. For a short distance ahead of the exit orifice, the flow area is kept constant, again mimicking a conventional solid stream nozzle. At the exit orifice the outer flow path limit suddenly diverges while the inner flow path limit continues with a converging angle some distance beyond the orifice. The angle of convergence gradually decreases until becoming nearly parallel to the nozzle axis. With this configuration, the outer surface of the forming stream is able to make a clean break from the internal nozzle surface while adhesion force between the water and the nozzle stem serves to pull the stream together in a tight cylindrical shape.

By providing a relatively long conical taper on the curvilinear conical end (44) and combining the nozzle stem with a stream shaper, the quality of the stream that is produced may be significantly improved over previous designs. In addition, as noted, the stream shaper also may serve to secure nozzle stem 32 in the nozzle assembly.

As noted above, the orifice adjustment is achieved by moving the nozzle stem axially along longitudinal axis 30*a* toward or away from nozzle orifice 35. Further, as noted above, this is achieved by adjustment mechanism 18. As best seen in FIG. 3 and, further, with reference to FIGS. 23-27, adjustment mechanism 18 includes a movable sleeve 50, which is positioned in transverse passageway 30 and, further, extends around stream shaper 34. Sleeve 50 typically comprises rigid material, such as a metal, including aluminum. Sleeve 50 extends through passageway 30 and is sealed against adapter 20 by a seal 20*a*, such as an o-ring seal, seated in groove 20*b* and sealed against adapter base 22 by a seal 22*a*, such as an o-ring seal, seated in groove 22*b*. To retain stream shaper 34 in sleeve 50, sleeve 50 includes a shoulder 52 formed on the inner wall of cylindrical portion 54 of sleeve 50. Shoulder 52 provides positive axial positioning of stream shaper 34 and, hence, nozzle stem 32 relative to sleeve 50. As will be more fully described below, sleeve 50 is movably mounted in nozzle body 12 for axial movement along longitudinal axis 30*a* so that the position of nozzle stem 32 (and stream shaper 34) may be controlled by the position of sleeve 50 within nozzle body 12.

To provide a smooth transition between the flow path through stream shaper 34 and the annular flow path defined around nozzle stem 32, opposed end 56 of sleeve wall 54 tapers from the edge of shoulder 52 until its terminal end that extends around nozzle stem 32. The angle of the tapered section 56 may be varied to change the rate of change of the cross-sectional area of the flow path. As noted above, the inwardly facing surfaces of nozzle body 12 and outer surface of nozzle stem 32 are designed to gradually and uniformly decrease as the flow progresses toward exit orifice 35.

Further, sleeve 50 is coupled to handle 16 in order to translate movement from handle 16 into movement of sleeve 50. In the illustrated embodiment, sleeve 50 is coupled to handle 16 by a pair of pins 60, which engage an engagement structure 58 provided on sleeve 50. In the illustrated embodiment, engagement structure 58 is configured by a pair of spaced flanges 58*a* and 58*b*, which define therebetween an annular track or groove in which pins 60 are located and laterally constrained by flanges 58*a* and 58*b*. Actuator pins 60, which form part of the actuator mechanism, are coupled to handle 16 and thus move in response to handle 16 being moved. When pins 60 move, pins 60 induce linear movement in sleeve 50 in passageway 30 and thereby move nozzle stem 32 and stream shaper 34 for adjusting the cross-sectional area of the flow. Further, as noted above, stem 32 may be configured to block the flow path to thereby provide a shutoff function. To provide a leak-tight shutoff, stem 32 optionally includes a seal such as an o-ring seal 92 (FIG. 3).

In the illustrated embodiment, actuator pins 60 are coupled to handle 16 by a pair of actuator disks (more fully described below); however, it should be understood that pins 60 and the actuator disks may be formed as a unitary part of handle 16. Alternately, pins 60 may be formed on sleeve 50, and the engagement structure may be formed on the disks or handle. Further, a single transverse pin that extends through the nozzle body may be provided.

Referring to FIGS. 7-12, central nozzle body 12*a* includes a wall 62, which defines therethrough a portion of passageway 30 and, further, provides a mounting surface for handle 16. As best understood from FIG. 3, outlet adapter 20 and inlet adapter assembly 21 are mounted in respective openings 64 and 66 of central nozzle body 12*a*. Central nozzle body 12*a* further includes a pair of opposed openings 68 and 69, which allow handle 16 to communicate with sleeve 50. Located in openings 68 and 69 are actuator disks 70, 72, which rotatably mount handle 16 to nozzle body 12 and, further, which support actuator pins 60. Disks 70 and 72 comprise a light weight, low friction but rigid material, such as a polymer, including DELRIN. Pins 60, which also may comprise a polymer material, such as DELRIN, are threaded into corresponding threaded openings in the disks. Handle 16, which comprises a generally U-shaped rigid member, typically formed from a metal, such as aluminum, is secured to actuator disks by fasteners 74 at its opposed ends. In the illustrated embodiment, fasteners 74 comprise threaded fasteners that extend through respective ends of handle 16 and into corresponding threaded mounting openings provided in actuator disks 70, 72, which are closely fitted in opposed openings provide in central nozzle body 12*a*, more fully described below. In this manner, when handle 16 is pivoted, disks 70 and 72 will rotate in openings 68 and 69 about rotational axis 75. Actuator pins 60 are mounted in actuator disks 70 and 72 radially outward from fasteners 34 such that when handle 16 is pivoted about fasteners 34, which are aligned along rotational axis 75 of the actuator disk, actuator pins 60 will be moved in an arcuate path about rotational axis 75 of actuator disks 70 and 72. When actuator pins 60 are pivoted about axis 75, actuator pins 60 will induce linear movement of sleeve 50 in passageway 30 to thereby move the position of nozzle stem 32 and stream shaper 34. To accommodate the differential movement between the pins and the sleeve flanges, pins 60 may be provided, such as by coating, with a low friction surface, which will allow pins 60 to slip relative to flanges 58*a* and 58*b*.

Figure 5:
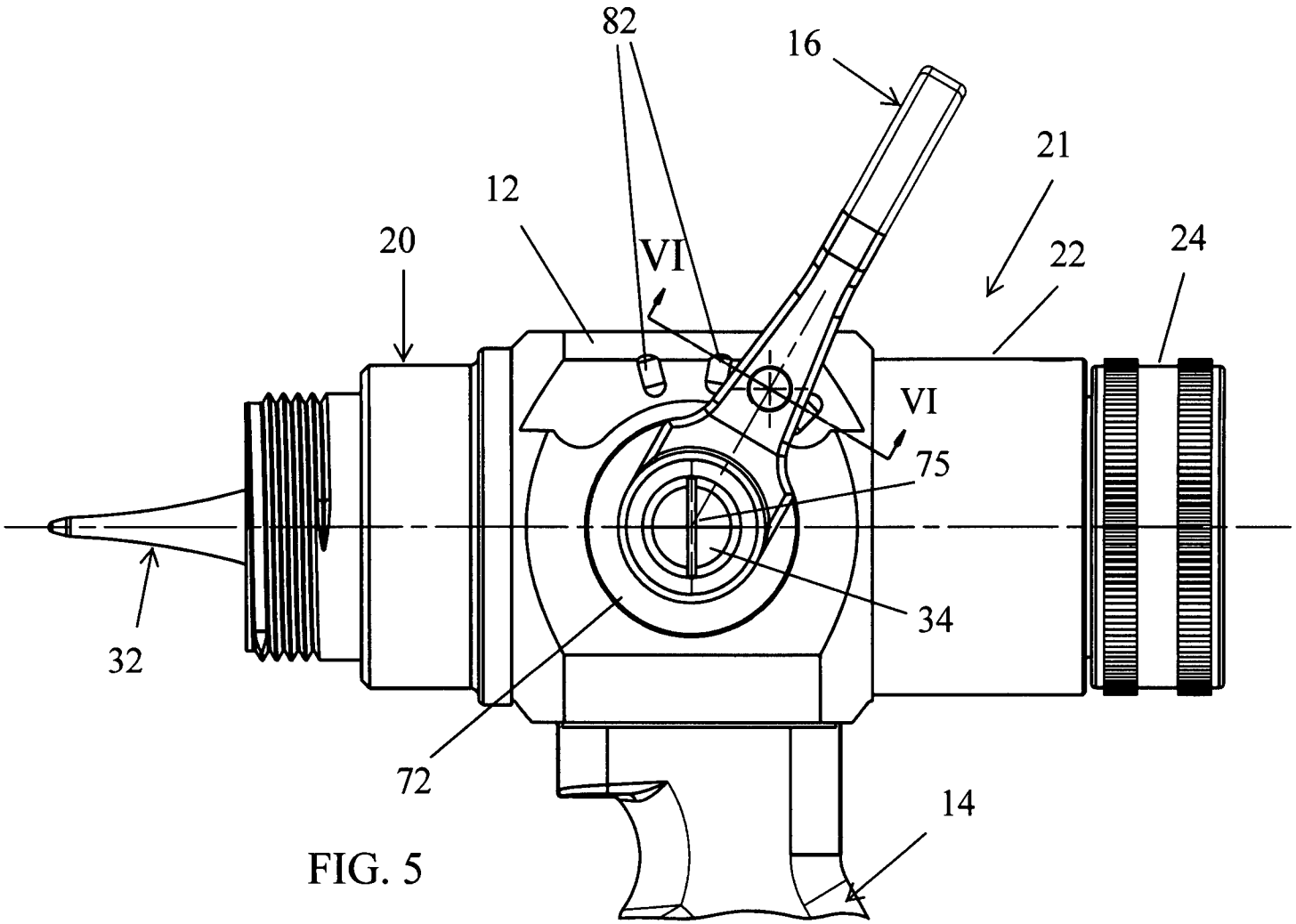
FIG. 5 is a fragmentary side elevation view of the nozzle assembly of FIG. 1.
Figure 6:
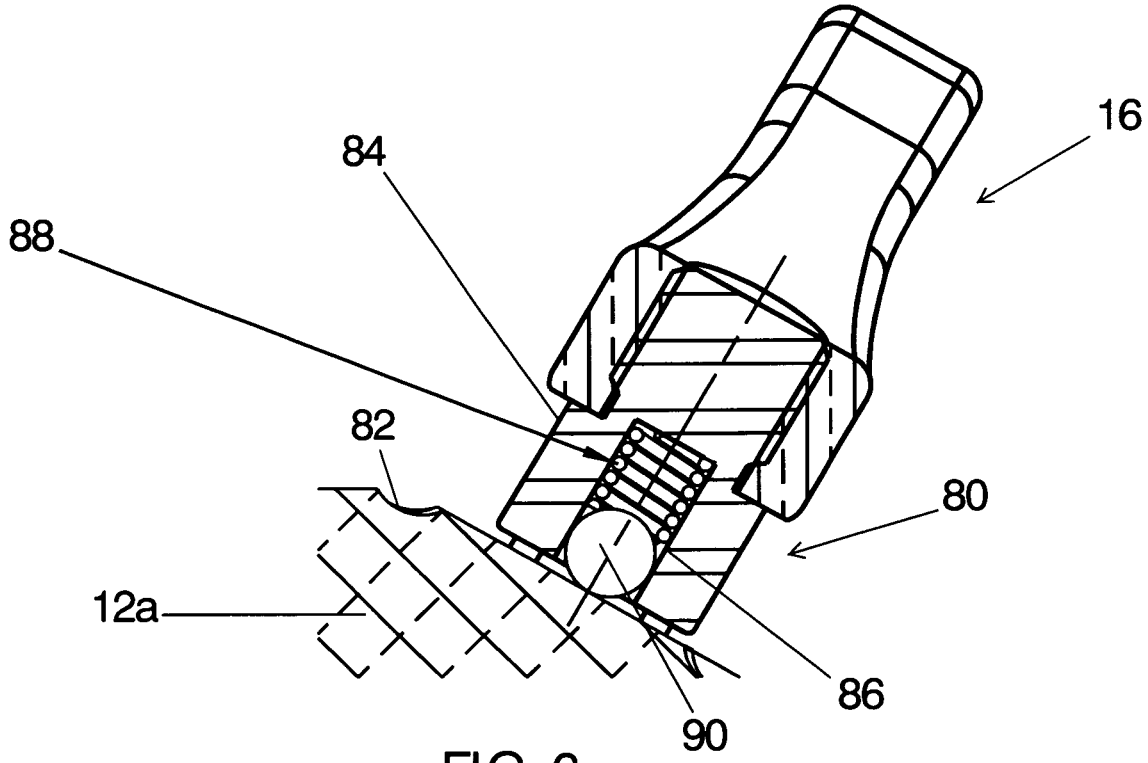
FIG. 6 is an enlarged detailed view taken long line VI-VI of FIG. 5.
Figure 7:
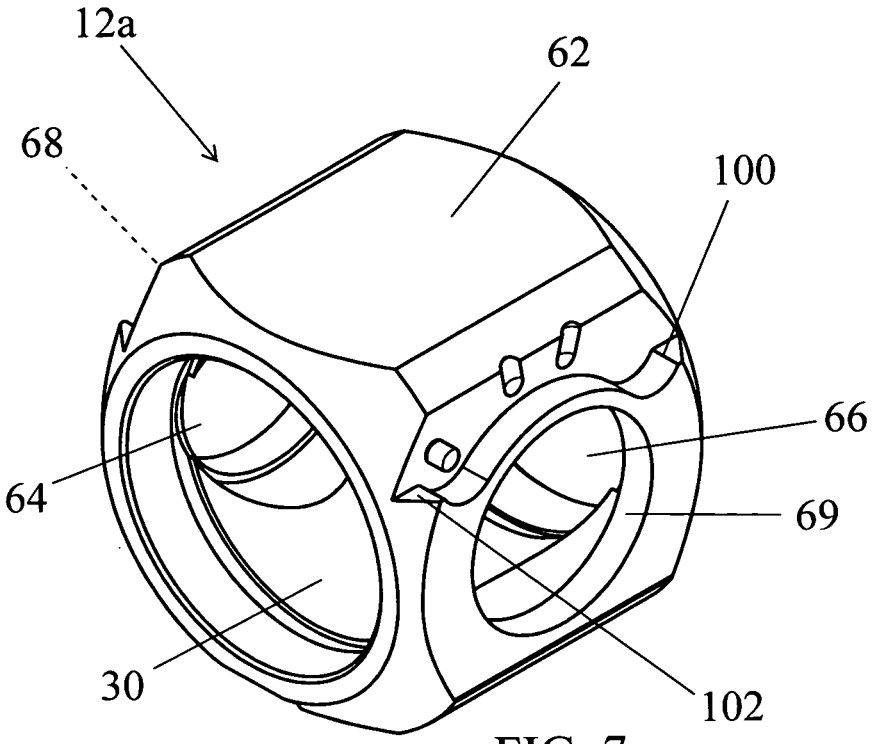
FIG. 7 is a perspective view of the central nozzle body of the nozzle assembly of FIG. 1.
Figure 8:
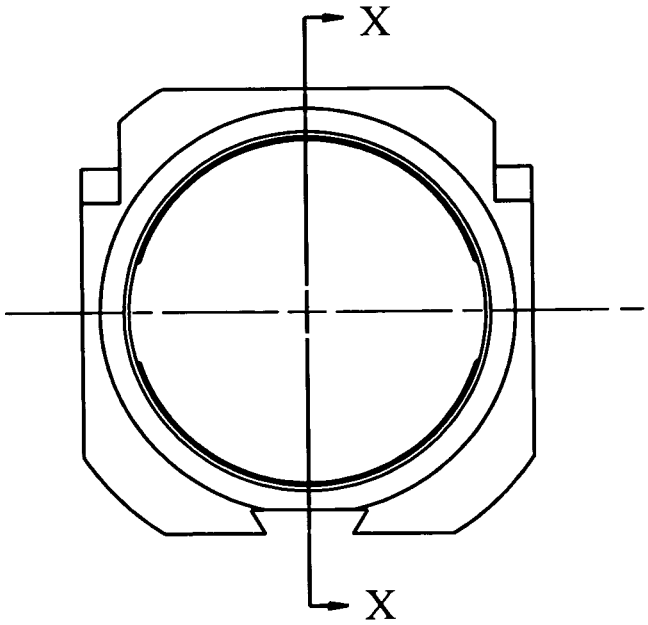
FIG. 8 is an end view of the central nozzle body of FIG. 7.
Figure 9:
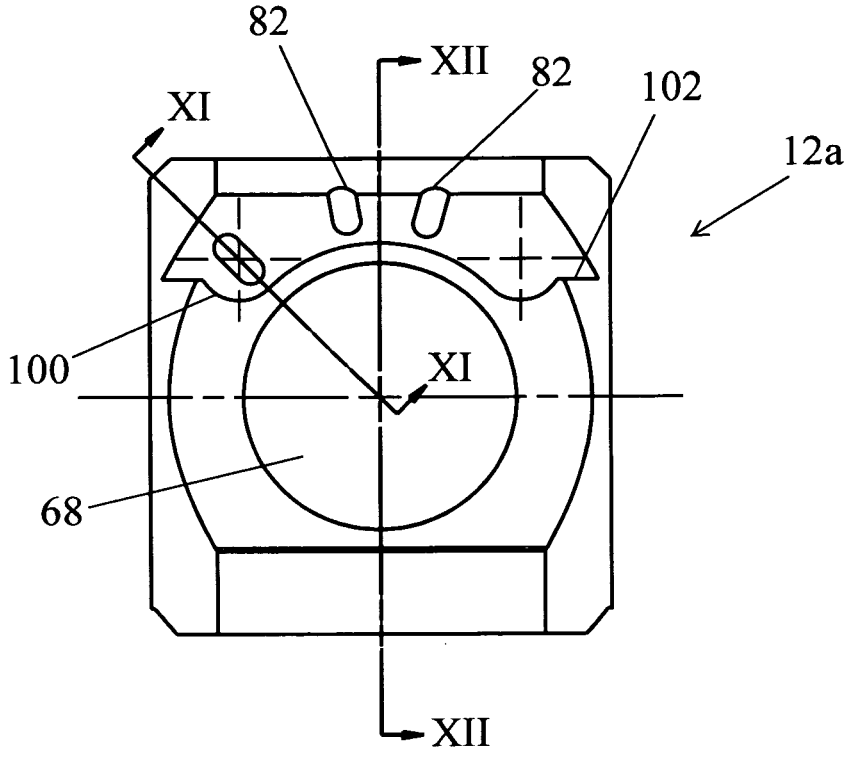
FIG. 9 is a side elevation view of the central nozzle body of FIG. 7.
Figure 10:
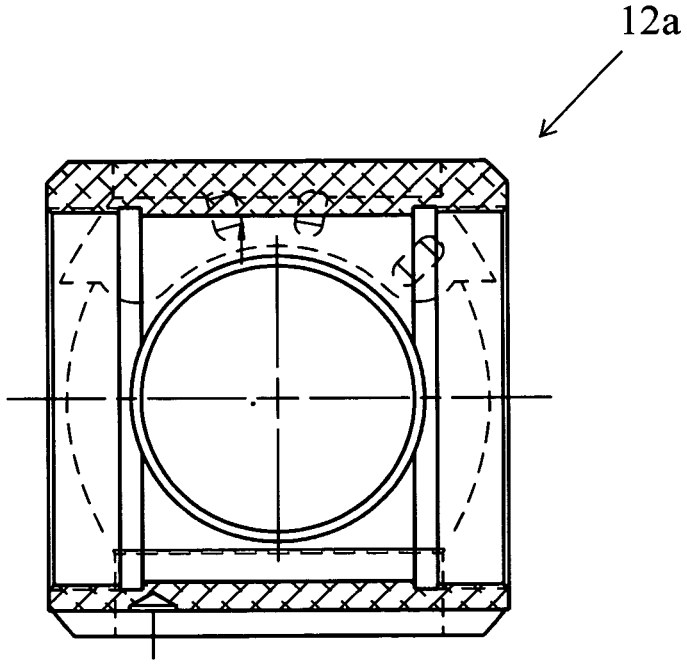
FIG. 10 is a cross-section view taken along line X-X of FIG. 8.
Figure 11:
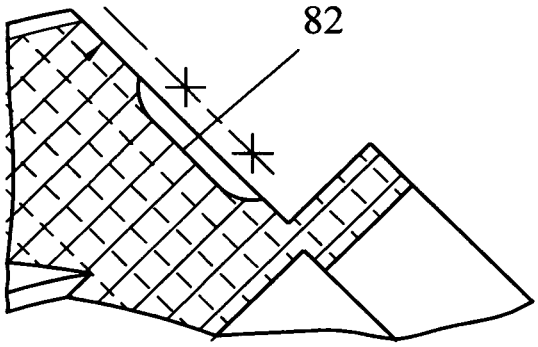
FIG. 11 is an enlarged cross-section view taken along line XI-XI of FIG. 9.
Figure 12:
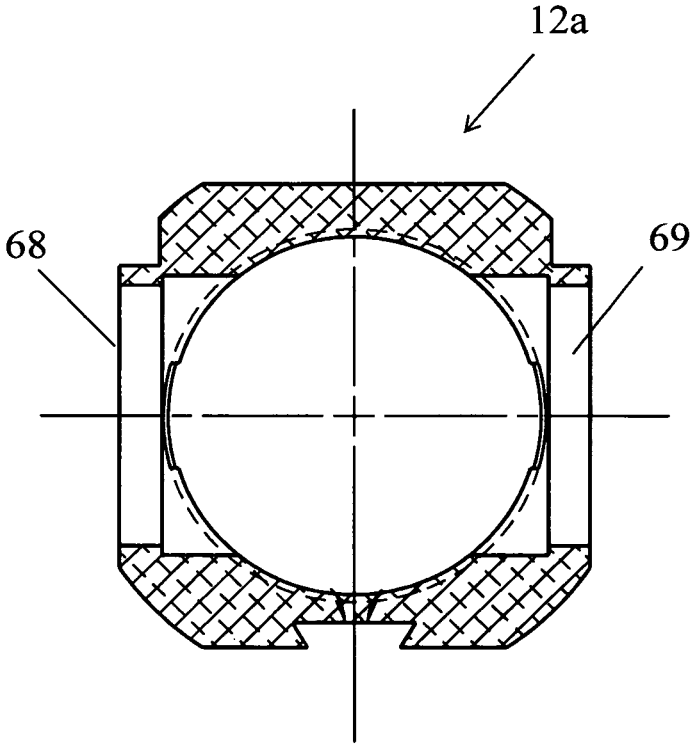
FIG. 12 is a cross-section view taken along line XII-XII of FIG. 9.
Figure 13:
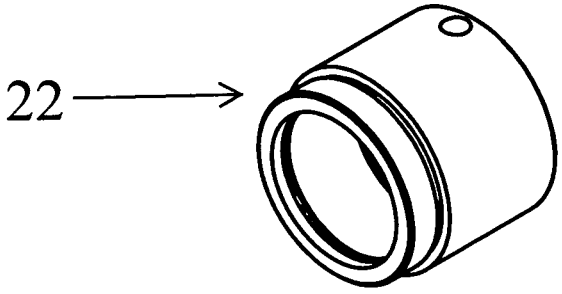
FIG. 13 is a perspective view of the inlet adapter base.
Figure 14:
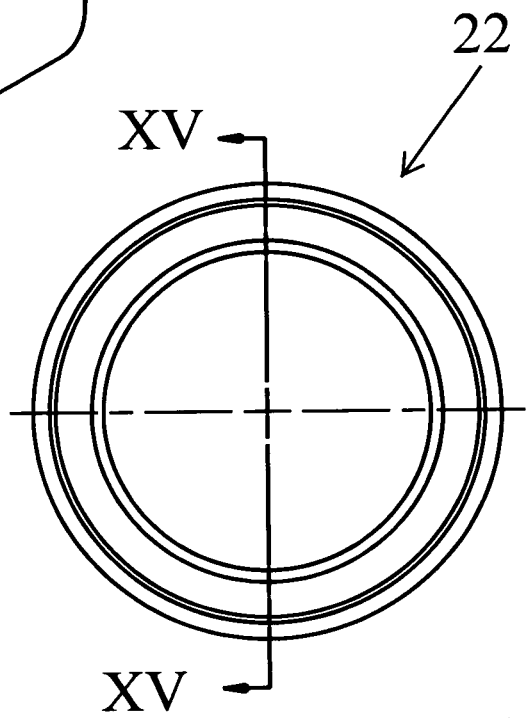
FIG. 14 is an end view of the inlet adapter base of FIG. 13.

Referring again to FIGS. 5 and 6, handle 16 includes a pair of detent mechanisms 80, which engage corresponding recesses 82 provided in central nozzle body 12*a*. Recesses 82 define predetermined positions for handle 16, which may, for example, correspond to flow areas or nozzle orifice sizes that provide flow rates similar to conventional solid stream nozzles. Each detent mechanism includes a detent body 84, which is mounted in handle 16 and, further, which includes a recess 86 for holding a spring 88 and a ball 90, which is urged outwardly by spring 88 to engage a respective recess 82 in nozzle body 12. In this manner, when the handle is aligned with the respective recesses, balls 90 will engage the recesses and thereby provide a movable stop position for the handle. The depth of the recesses is such that an additional force must be applied in order to compress the springs and urge the balls back into the recesses 86 (against the force of the springs 88) to thereby allow the handle to move. The detent locations are angularly calibrated to correspond to desired nozzle orifice sizes and may provide flow rate similar to specific sized conventional solid stream nozzles. However, it should be understood that the number of recesses may be varied and further an arcuate slot may be provided to allow for an infinite number of positions in lieu of discrete positions to thereby give a wider range of nozzle orifice sizes.

As noted above, when handle 16 is moved to the right as viewed in FIG. 3, which corresponds to the closed position of the nozzle, nozzle stem 32 will be moved towards outlet orifice 35 such that its outer surface rests against the inner surface of passageway 30 to thereby close nozzle orifice 35. As noted, to provide a leak-tight shutoff, seal 92 is provided on nozzle stem. For example, referring to FIG. 3, seal 92 optionally comprises an o-ring seal, which is optionally located in a recess 94 provided on exterior surface of tapered conical section 44 of nozzle stem body 36. Furthermore, handle 16 may incorporate a pair of lugs 98 formed on the inwardly facing sides of the opposed ends of the handle 98, which provide a stop position for handle 16 against actuator walls 100 and 102 formed on actuator body 12. In the illustrated embodiment, walls 100 and 102 and lugs 98 provide positive stops for the fully open and fully closed position of the nozzle assembly.

Figure 43:
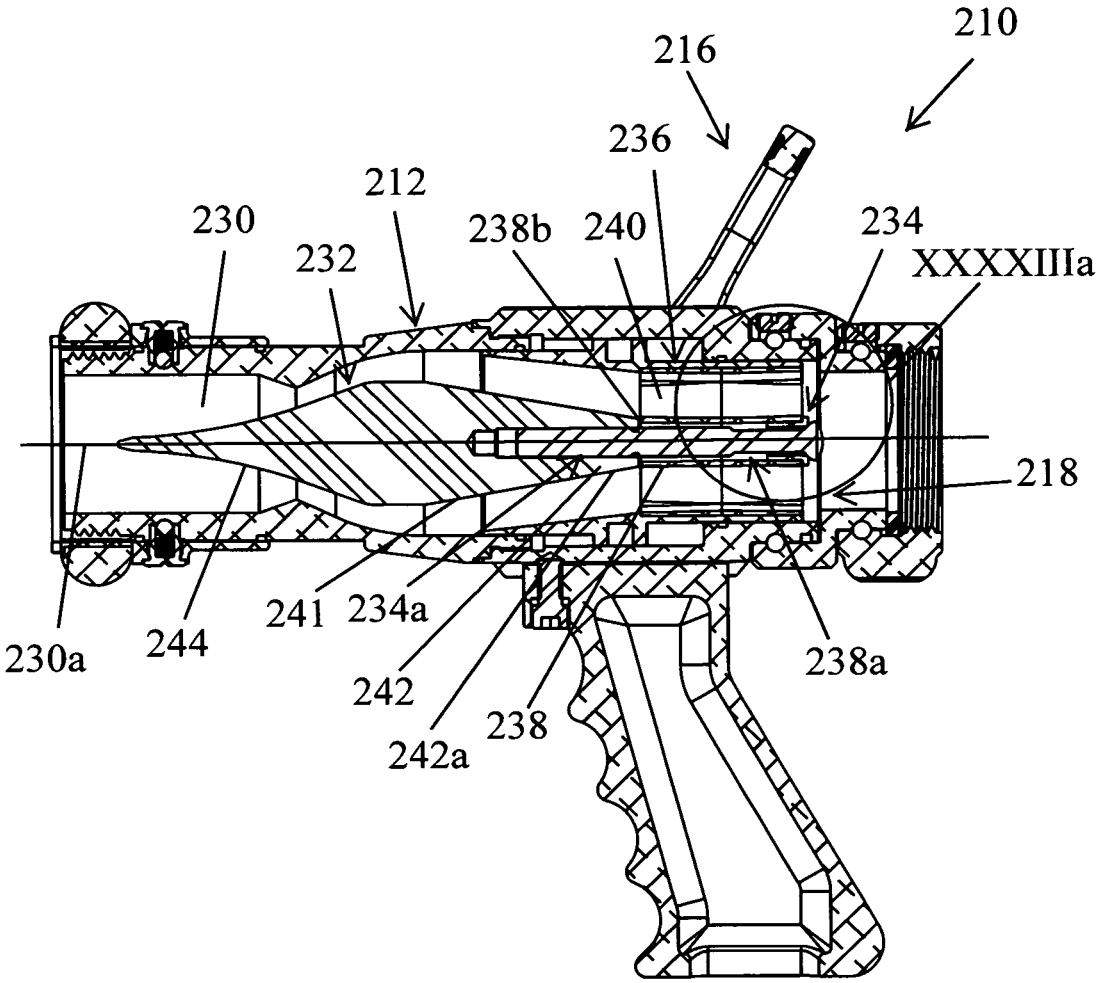
FIG. 43 is a cross-section view of another embodiment of the nozzle assembly of the present invention.

Referring to FIG. 43, the numeral 210 generally designates another embodiment of a solid stream nozzle assembly of the present invention. Nozzle assembly 210 is similar to nozzle assembly 10 but includes a modified mounting arrangement for its adjustment mechanism 218, which is located in nozzle body 212 to adjust the cross-section of the flow area of the nozzle orifice in response to the movement of its handle 216.

As best seen in FIG. 43, nozzle stem 232 and stream shaper 234 are both mounted for linear movement along axis 230*a* similar to the first embodiment. Also, stream shaper 234 supports nozzle stem 232 in passage and is mounted to the end of the nozzle stem body 232 by a rod or pin 234*a*, which threads into the end of stem 232, but allows stem 232 to swivel or pivot with respect to stream shaper 234.

Stream shaper 234 is of similar construction to stream shaper 34 and includes an outer cylindrical wall 236, an inner cylindrical wall 238, and a plurality of webs 240 interconnecting the cylindrical walls. Unlike the previous embodiment, in which stem 32 includes a cylindrical end 42*c* for inserting into the passageway 38*a* formed by inner cylindrical wall 38 (FIGS. 28, 30, and 32), the end 242*a* of stem 232 abuts the end of inner cylindrical wall 238 and is, therefore, at least to some degree laterally unrestrained by stream shaper 234 so that stem 232 can move laterally in passageway 230 (FIGS. 46 and 47).

Figure 43A:
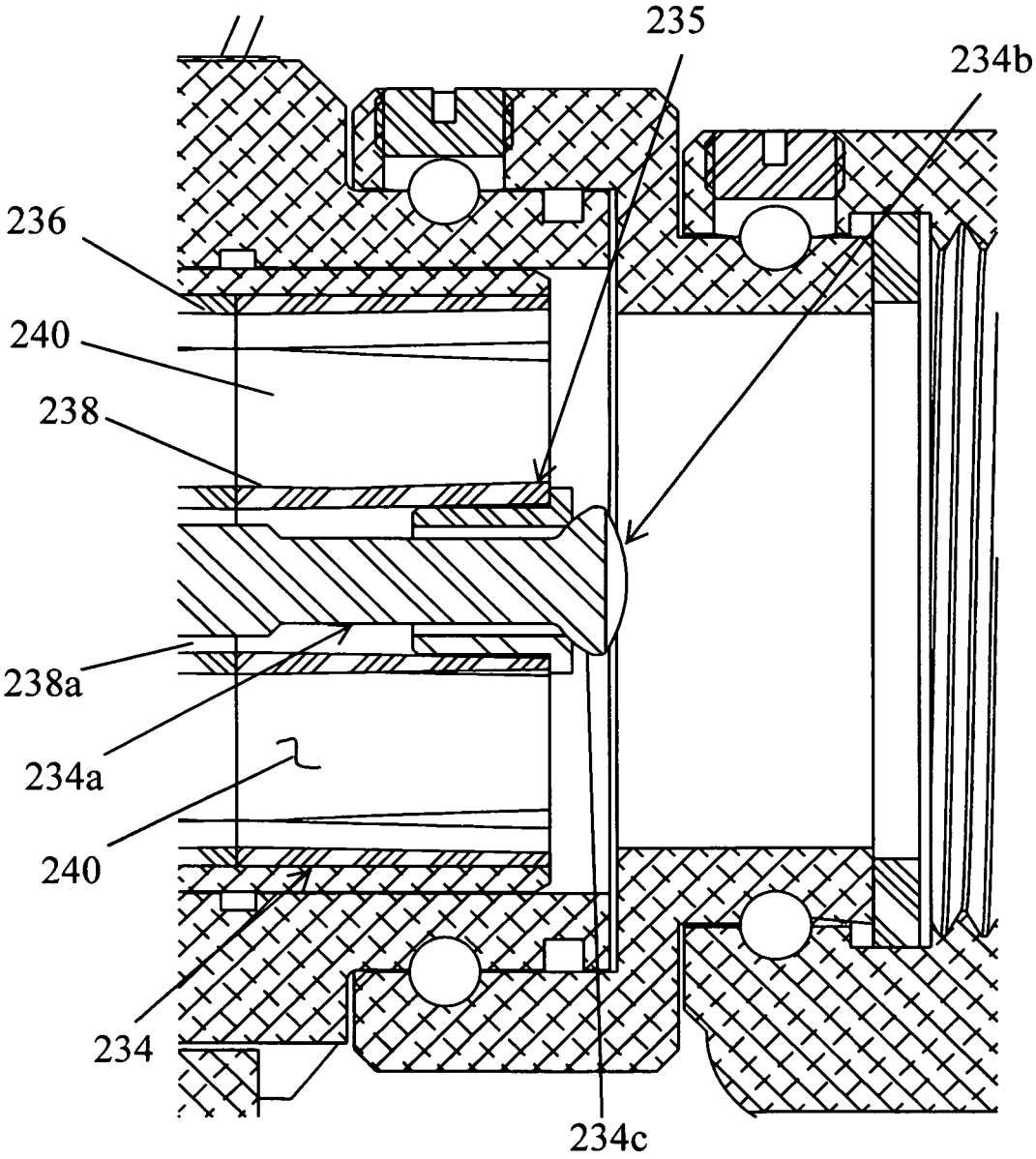
FIG. 43*a* is an enlarged view of detail XXXXIIIa of FIG. 43.
Figure 46:
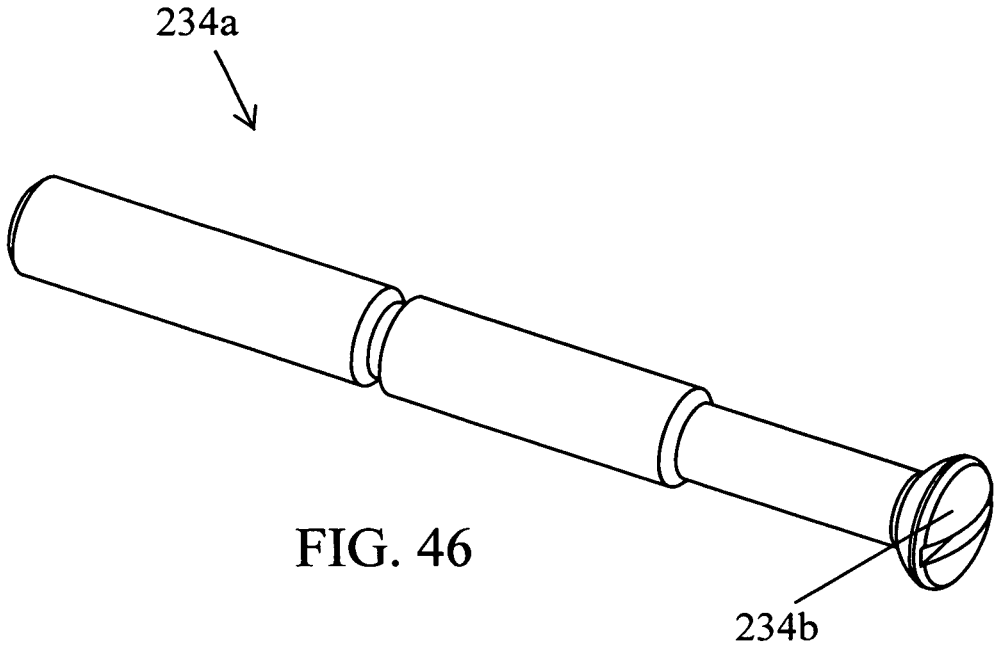
FIG. 46 is an enlarged perspective view of the coupler that mounts the stem in the nozzle assembly.
Figure 47:
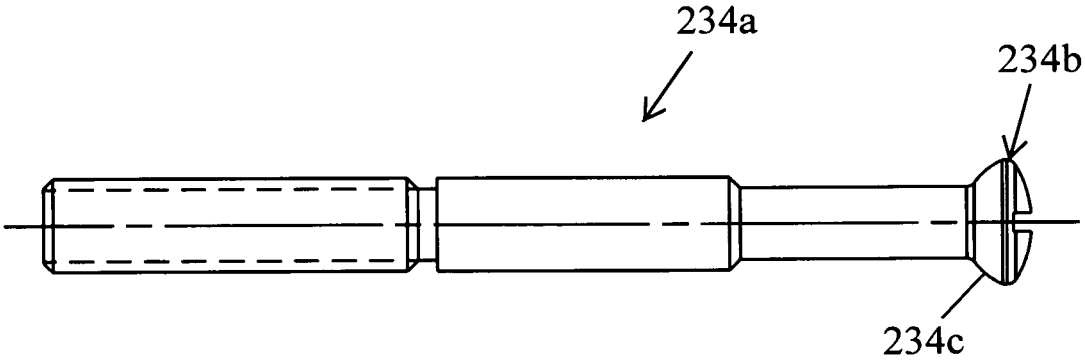
FIG. 47 is a side view of the coupler of FIG. 46.

As best seen in FIGS. 46 and 47, rod 234*a* includes an enlarged end 234*b* with a non-planar contact surface 234*c* for contacting stream shaper 234 (FIG. 43*a*) and optionally a bushing insert 235 that may be located in passageway 238. In this manner, rod 234*a* provides a pivot surface so that stem 232 may pivot about its proximal end. Consequently, as noted, distal end 232*a* of stem 232 can move laterally in passageway 230, which allows the fluid flowing through passageway to substantially center stem 232 in passageway 230. It has been found that rather than trying to adhere to strict manufacturing tolerances on the stem and stream shaper to achieve a rigid and centered mounting for the stem, by generally locating the stem in the center of passageway 230*a*, e.g. along axis 230*a*, the flow of fluid flowing through passageway 230*a* will locate the stem in the center due to the fluid forces on the stem, and the stem will tend to self-center more accurately than with rigid placement in the passageway.

Figure 44:
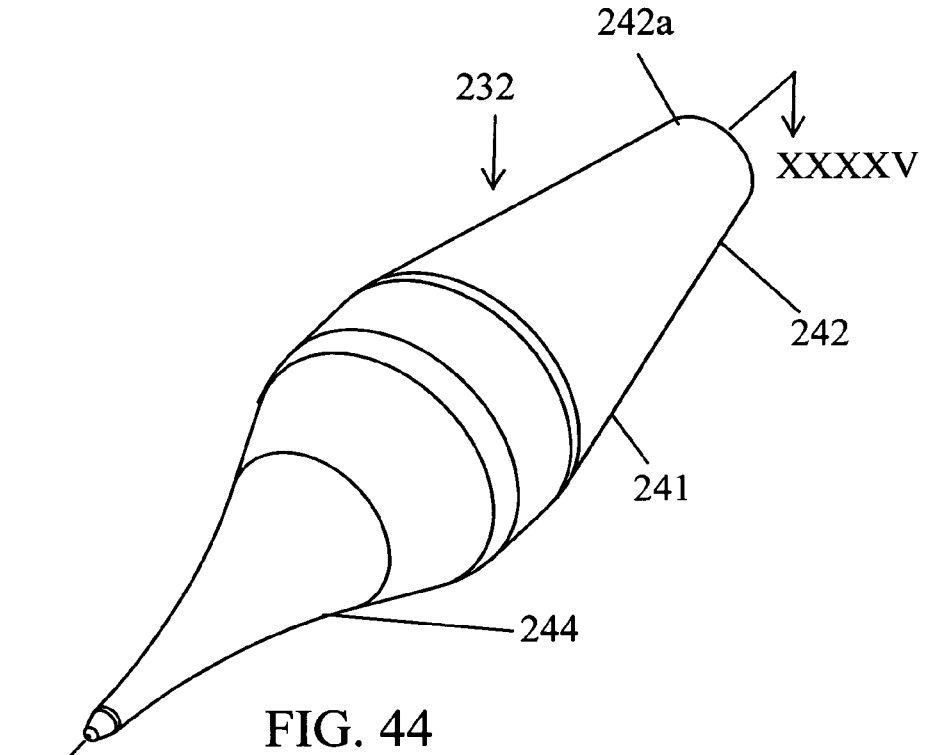
FIG. 44 is a perspective view of the nozzle stem of FIG. 43.
Figure 45:
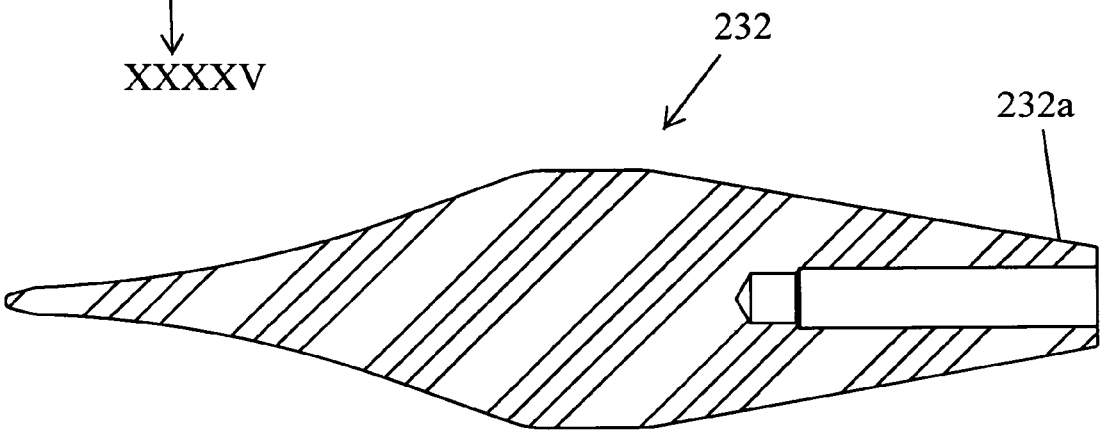
FIG. 45 is an enlarged cross-section taken along line XXXXV-XXXXV of FIG. 44.

Referring to FIGS. 44 and 45, non-planar surface 234*c* optionally comprises a spherical surface so that rod may swivel or pivot in a conical space about axis 230*a*. Similar to stem 32, nozzle stem 232 also comprises a generally bicone-shaped body 241 with one end 242 of body 241 comprising a linear cone-shaped portion and an opposed end 244 of body 241 comprising a curvilinear cone-shaped portion. As noted, however, in the illustrated embodiment, the insertion of the end of the stem into the stream shaper of the first embodiment has been eliminated to allow stem to move laterally with respect to stream shaper 234. For further details of the nozzle body and the nozzle assembly handle, and how the stem is used, reference is made to the first embodiment of the present invention. Consequently, adjustment mechanism 218 is easier to manufacture and to install.

While several forms of the invention have been shown and described, other changes and modifications will be appreciated by those skilled in the relevant art. For example, features of one embodiment may be combined with features of other embodiments. Also, although described in reference to a solid stream nozzle assembly, features of the present invention may be incorporated into other types of nozzle assemblies. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which we claim an exclusive property right or privilege are defined as follows:

1. A firefighting nozzle assembly comprising:

a nozzle body having an inlet, an outlet, and a passageway extending from said inlet to said outlet, said passageway having a flow area and a fixed diameter at said outlet;

a lever supported at said nozzle body;

an actuator, said actuator supported by said nozzle body;

a movable body disposed in said passageway, said movable body supported for linear movement in said passageway, and being responsive to movement of said lever, and said movable body reducing the flow area through said outlet when said movable body is moved toward said outlet and increasing the flow area when moved away from said outlet, said movable body having a distal end and a proximal end, said distal end being closer to said outlet than said proximal end and being laterally movable within the passageway so that water flow through the passageway centers said distal end of said movable body in said passageway, and said movable body further comprising an elongate body with said distal end formed at one end of said elongate body and said proximal end formed at an opposed end of said elongate body, said proximal end being supported by a pin connection in said passageway wherein said distal end is pivotable with respect to said proximal end and is laterally movable in the passageway wherein fluid flowing in said passageway generally centers said movable body in said passageway; and a stream shaper, said stream shaper coupled to said movable body and moving with said movable body when said movable body is moved in said passayay in response to movement of said lever;

said proximal end of said movable body is pivotally mounted to said stream shaper wherein said distal end of said movable body is laterally movable with respect said stream shaper.

2. The firefighting nozzle assembly according to claim 1, wherein said lever comprises a handle.

3. The firefighting nozzle assembly according to claim 1, wherein said movable body has a generally bicone-shaped body.

4. The firefighting nozzle assembly according to claim 3, wherein said generally bicone-shaped body comprises a curvilinear conical downstream end and a linear cone-shaped upstream end.

5. The firefighting nozzle assembly according to claim 4, wherein said generally bicone-shaped body comprises a cylindrical-shaped portion between said curvilinear conical downstream end and said linear cone-shaped upstream end.

6. The firefighting nozzle assembly according to claim 1, wherein said stream shaper supports said movable body in said passageway.

7. The firefighting nozzle assembly according to claim 1, wherein said stream shaper includes an outer cylindrical wall, an inner cylindrical wall, and a plurality of webs extending between said outer cylindrical wall and said inner cylindrical wall to define a plurality of fluid passageways.

8. The firefighting nozzle assembly according to claim 1, wherein said lever includes a plurality of predefined positions corresponding to outlet flow areas of a plurality of conventional fixed orifice nozzles.

9. The firefighting nozzle assembly according to claim 1, wherein said lever includes a plurality of predefined positions corresponding to predefined positions of said movable body.

10. The firefighting nozzle assembly according to claim 1, wherein said nozzle body includes a central nozzle body, an outlet adapter mounted to said central nozzle body, and an inlet adapter mounted to said central nozzle body.

11. The firefighting nozzle assembly according to claim 10, wherein said inlet adapter comprises an inlet adapter assembly with an adapter base mounted to said central nozzle body and a swivel inlet body rotatably mounted in said adapter base.

12. The firefighting nozzle assembly according to claim 10, wherein said outlet adapter includes a connection for mounting an accessory to said nozzle body.

13. The firefighting nozzle assembly according to claim 12, wherein said connection comprises a threaded connection.

14. The firefighting nozzle assembly according to claim 1, wherein said movable body includes a sealing surface for sealing the outlet when said movable body is moved to a closed position in response to said lever being moved to a position for shutting off flow through the nozzle assembly.

15. The firefighting nozzle assembly according to claim 1, wherein said movable body is supported for linear movement in said passageway, said movable body having a varying cross-section so that when said movable body is moved longitudinally in the passageway the cross-section of the flow area through the passageway is varied.

16. The firefighting nozzle assembly according to claim 1, wherein said proximal end of said movable body is pivotably secured within said passageway to allow said movable body to pivot about said proximal end while remaining supported for linear movement responsive to movement of said lever.

17. The firefighting nozzle assembly according to claim 16, further comprising a pin, said pin pivotally mounting said proximal end of said movable body in said passageway.

18. The firefighting nozzle assembly according to claim 17, wherein said pin has a non-planar bearing surface, said non-planar bearing surface pivotally mounting said proximal end of said movable body in said passageway.

19. A firefighting nozzle assembly comprising:

a nozzle body having an inlet, an outlet, and a passageway extending from said inlet to said outlet, said passageway having a flow area and a fixed diameter at said outlet;

a lever supported at said nozzle body;

an actuator, said actuator supported by said nozzle body;

a movable body disposed in said passageway, said movable body supported for linear movement in said passageway and being responsive to movement of said lever, and said movable body reducing the flow area through said outlet when said movable body is moved toward said outlet and increasing the flow area when moved away from said outlet;

said movable body comprising means for sealing said outlet when said movable body is moved to a closed position in response to said lever being moved to a position for shutting off flow through said nozzle assembly;

a means for reducing the scale of turbulence in an incoming water flow, said means for reducing coupled to said movable body and moving with said movable body when said movable body is moved in said passageway in response to movement of said lever, said actuator configured for varying the cross-section of the flow area through said outlet in response to said lever being moved relative to said nozzle body; and means for centering a distal end of said movable body in said passageway when water flows through said passageway, said means for centering comprises means for pivotably connecting said movable body to said means for reducing.

20. The firefighting nozzle assembly according to claim 19, wherein said movable body has a generally bicone-shaped body.

21. The firefighting nozzle assembly according to claim 20, wherein said generally bicone-shaped body comprises a curvilinear conical downstream end and a linear cone-shaped upstream end.

22. The firefighting nozzle assembly according to claim 21, wherein said generally bicone-shaped body comprises a cylindrical-shaped portion between said curvilinear conical downstream end and said linear cone-shaped upstream end.

23. The firefighting nozzle assembly according to claim 19, wherein said means for reducing includes means for supporting said movable body in said passageway.

24. The firefighting nozzle assembly according to claim 19, wherein said means for reducing comprises a stream shaper including an outer cylindrical wall, an inner cylindrical wall, and a plurality of webs extending between said outer cylindrical wall and said inner cylindrical wall to define a plurality of fluid passageways.

25. The firefighting nozzle assembly according to claim 19, wherein said lever comprises a means for selecting an outlet flow area corresponding to one of a plurality of conventional fixed orifice nozzles.

26. The firefighting nozzle assembly according to claim 19, further comprising connection means for mounting an accessory to said nozzle body.

* * * * *

UNITED STATES PATENT AND TRADEMARK OFFICE

CERTIFICATE OF CORRECTION

PATENT NO. : 8,584,768 B2
APPLICATION NO. : 12/370372
DATED : November 19, 2013
INVENTOR(S) : Trapp et al.

It is certified that error appears in the above-identified patent and that said Letters Patent is hereby corrected as shown below:

In the Claims

In Claim 1, Column 10, Line 57, please change the word passayay to passageway

Signed and Sealed this
Seventh Day of January, 2014

Margaret A. Focarino

Margaret A. Focarino
*Commissioner for Patents of the United States Patent and Trademark Office*